US011261669B1

(12) United States Patent
Alzaki

(10) Patent No.: US 11,261,669 B1
(45) Date of Patent: Mar. 1, 2022

(54) DEVICE, ASSEMBLY, AND METHOD FOR RELEASING CUTTERS ON THE FLY

(71) Applicant: SAUDI ARABIAN OIL COMPANY, Dhahran (SA)

(72) Inventor: Hussien A. Alzaki, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/234,418

(22) Filed: Apr. 19, 2021

(51) Int. Cl.

| | |
|---|---|
| ***E21B 10/627*** | (2006.01) |
| ***E21B 10/633*** | (2006.01) |
| ***E21B 12/02*** | (2006.01) |
| ***E21B 47/013*** | (2012.01) |

(52) U.S. Cl.
CPC ..... *E21B 10/627* (2013.01); *E21B 12/02* (2013.01); *E21B 47/013* (2020.05)

(58) Field of Classification Search
None
See application file for complete search history.

(56) References Cited

U.S. PATENT DOCUMENTS

| | | | | |
|---|---|---|---|---|
| 2,489,687 | A * | 11/1949 | Thrift | E21B 12/02 175/39 |
| 7,533,738 | B1 * | 5/2009 | Hall | E21B 10/633 175/327 |
| 7,549,485 | B2 | 6/2009 | Radford et al. | |
| 7,703,557 | B2 | 4/2010 | Durairajan et al. | |
| 10,214,968 | B2 * | 2/2019 | Evans | E21B 44/005 |
| 10,287,825 | B2 | 5/2019 | Chen et al. | |
| 10,650,108 | B2 | 5/2020 | Chen | |
| 11,111,730 | B2 * | 9/2021 | Chanpura | E21B 47/09 |
| 2010/0270085 | A1 | 10/2010 | Turner et al. | |
| 2012/0318580 | A1 * | 12/2012 | Oesterberg | E21B 10/62 175/57 |
| 2013/0098682 | A1 | 4/2013 | Desai | |
| 2014/0311801 | A1 * | 10/2014 | Jain | E21B 10/08 175/27 |
| 2015/0376952 | A1 | 12/2015 | McCarthy et al. | |
| 2017/0130534 | A1 * | 5/2017 | Nguyen | E21B 10/55 |
| 2017/0275951 | A1 * | 9/2017 | Thomas | E21B 10/43 |
| 2018/0010396 | A1 * | 1/2018 | Dunbar | E21B 10/573 |

FOREIGN PATENT DOCUMENTS

| | | | |
|---|---|---|---|
| CA | 2745812 | A1 | 6/2010 |
| CA | 2872458 | C | 9/2019 |
| GB | 2421042 | A | 6/2006 |

* cited by examiner

*Primary Examiner* — Kipp C Wallace
(74) *Attorney, Agent, or Firm* — Osha Bergman Watanabe & Burton LLP

(57) ABSTRACT

A drill bit device may include a cutter housing delimited by an outermost surface and various walls forming a socket. The drill bit device may include various main cutters disposed on an outermost surface of the cutter housing. The various main cutters may be configured to move in an outward direction upon receiving a predetermined pressure. The drill bit device may include various pre-charged cutters disposed immediately behind the various main cutters inside the cutter housing. The various pre-charged cutters may be configured to move in the outward direction upon receiving the predetermined pressure. The drill bit device may include a gate that connects the cutter housing to an internal groove that may be directly connected to a port switch that may allow release of the predetermined pressure through the internal groove and into the gate.

18 Claims, 20 Drawing Sheets

200

COMMUNICATION SYSTEM
210
Transmitter
212
Receiver
214
100
PROCESSING SYSTEM
220
MEMORY
224
PROCESSOR
222
250
SENSING SYSTEM
230
EXTERNAL AND INTERNAL SENSORS
232
SAMPLING SYSTEM
240
COLLECTION CONTROLLER
242
260
270
170A
170B
170C
170D

DEVICE, ASSEMBLY, AND METHOD FOR RELEASING CUTTERS ON THE FLY

BACKGROUND

As part of a well drilling operation, drill bits are essential tools in creating a borehole. Drill bits are manufactured in different sizes and features as they are subjected to different formations with different environments. Drill bits are used to drill to a desire depth of interest, or a formation of interest. In some harsh environments, a couple of drill bit runs are required as cutters fail to withstand abrasive formations. Currently, drill bit replacements require several hours of downtime, which slow down the process of drilling operations, and increase cost and risk associated with replacing cutters.

SUMMARY

In general, in one aspect, embodiments disclosed herein relate to a drill bit device. The drill bit device includes a cutter housing delimited by an outermost surface and various walls forming a socket. The drill bit device includes various main cutters disposed on an outermost surface of the cutter housing. The various main cutters are configured to move in an outward direction upon receiving a predetermined pressure. The drill bit device includes various pre-charged cutters disposed immediately behind the various main cutters inside the cutter housing. The various pre-charged cutters are configured to move in the outward direction upon receiving the predetermined pressure. The drill bit device includes a gate that connects the cutter housing to an internal groove. The internal groove is directly connected to a port switch that allows release of the predetermined pressure through the internal groove and into the gate. The various walls of the cutter housing are disposed around the various main cutters and the various pre-charged cutters. The predetermined pressure causes a set of main cutters out of the various main cutters to be released out of the cutter housing and causes a set of pre-charged cutters out of the various pre-charged cutters to move onto the outermost surface of the cutter housing.

In general, in one aspect, embodiments disclosed herein relate to a drill bit assembly. The drill bit assembly includes a chassis with a connecting thread, a drill bit neck, and a drill bit body. The drill bit assembly includes various drill bit devices disposed in multiple positions of the drill bit body. Each drill bit device includes a cutter housing delimited by an outermost surface and various walls forming a socket. Each drill bit device includes various main cutters disposed on an outermost surface of the cutter housing. The various main cutters are configured to move in an outward direction upon receiving a predetermined pressure. Each drill bit device includes various pre-charged cutters disposed immediately behind the various main cutters inside the cutter housing. The various pre-charged cutters are configured to move in the outward direction upon receiving the predetermined pressure. Each drill bit device includes a gate that connects the cutter housing to an internal groove. The internal groove is directly connected to a port switch that allows release of the predetermined pressure through the internal groove and into the gate. The various walls of the cutter housing are disposed around the various main cutters and the various pre-charged cutters. The predetermined pressure causes a set of main cutters out of the various main cutters to be released out of the cutter housing and causes a set of pre-charged cutters out of the various pre-charged cutters to move onto the outermost surface of the cutter housing. The drill bit neck includes the port switch. The drill bit body houses the internal groove, the external groove extending from the drill bit neck to each gate of each drill bit device out of the various drill bit devices.

In general, in one aspect, embodiments disclosed herein relate to a method for releasing cutters from a drill bit assembly. The method includes activating a port switch placed at a drill bit neck of the drill bit assembly. The method includes releasing a predetermined pressure into an internal groove in response to the activation. The internal groove extends from the port switch to various cutter housings located at an outer surface of the drill bit assembly. The method includes receiving the predetermined pressure in the cutter housing. The predetermined pressure is a first type of pressure or a second type of pressure. The method includes comparing the predetermined pressure to a threshold. Results of the comparison indicate whether the predetermined pressure is smaller than the threshold or equal or larger than the threshold. The method includes determining the predetermined pressure as the first type of pressure when the predetermined pressure is smaller than the threshold or determine the predetermined pressure as the second type of pressure when the predetermined pressure is equal or larger than the threshold. The method includes releasing a first group of main cutters in response to the first type of pressure and releasing a second group of main cutters in response to the second type of pressure.

Other aspects of the disclosure will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1A:
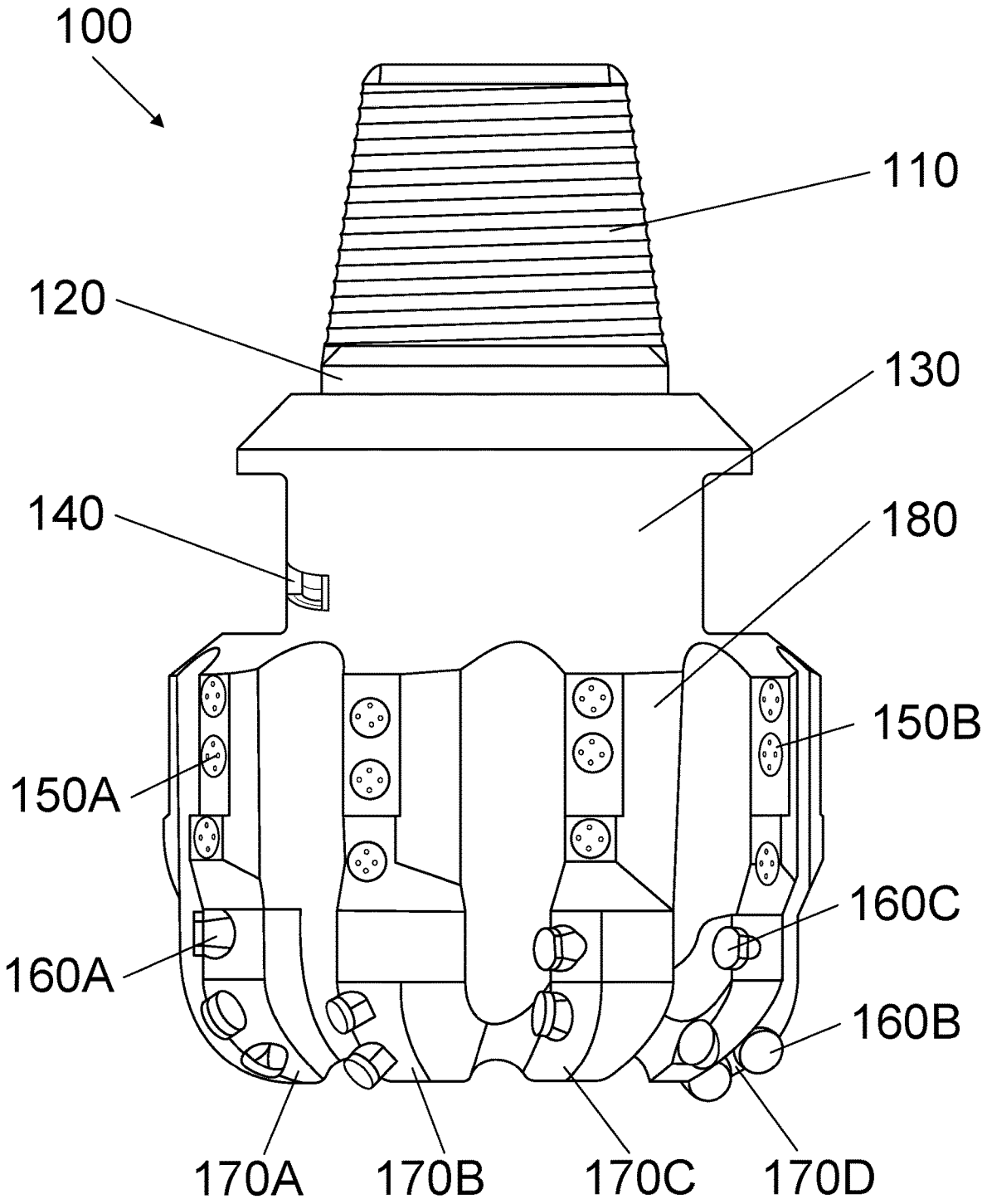
FIGS. 1A and 1B show a drill bit assembly in accordance to one or more embodiments.

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include a device, an assembly and a method for releasing cutters on the fly. In some embodiments, releasing cutters on the fly allow operators to save an operation's time and cost as the cutters may be replaced without removing a drill bit assembly on its entirety. Further, the lifetime of the drill bit assembly may be extended to allow immediate reloading of new cutters. Some embodiments also reduce operation risks associated with preforming multiple trips across formations. This implementation reduces risks of getting stuck and reduces a time of being exposed to open borehole. The drill bit device may have various main cutters and various pre-charged cutters that may act as back-up cutters to the main cutters. The number of loads, quintets and placement may be determine based on applications. In some embodiments, the drill bit device may provide flexibility for using a number of blades, cutter design, size, and count cycles for all available bit sizes. The drill bit device may have a housing that forms a cartridge or socket in a bit buddy that allows cutter change/drop from the drill bit assembly on command. In this regard, commands may be given by establishing pressure cycling, ball activation, using radio frequency identification (RFID) chips, and measurement while drilling (MWD) down-linking activation. These activation schemes may move the main cutters forward and towards an outside of the drill bit device and may move the pre-charged cutters into the location previously occupied by the main cutters. Once, the pre-charged cutters have been used, the drill bit device may be replaced with another drill bit device by replacing the socket or the cartridge from the drill bit assembly.

As noted above, drill bits are essential tool in creating borehole as part of well drilling operation. In some embodiments, the drill bit device is manufactured to fit in different sizes and features as they are subjected to different formations with different environments. As drill bit assemblies are used to drill to a desire depth of interest, or a formation of interest, in some harsh environments, operations involving the drill bit device does not need to run as cutters fail to withstand abrasive formations. Instead, cutter replacements may occur on the fly as drill bit replacements are not required.

In one or more embodiments, the method starts with activation/deactivation of a switch port placed on a chassis of the drill bit assembly. The switch port allows a predetermined amount of pressure to pass through internal grooves of drill bit assembly. The grooves are directed to predetermined drill bit devices. Each of these drill bit devices may be equipped with any number of cutters rated with different shear pins configured for selective drop of cutters. For example, a set of main cutters in a drill bit device may be released after receiving a pressure equal to 500 psi and another set of main cutters in another drill-bit device may be released after receiving another pressure equal to 700 psi. Further, a third set of main cutters may be rated to be released after receiving pressures equal to 1000 psi or equal to 1200 psi. The predetermined pressure released and/or the pressure to be received may be different based on specific drill bit assembly applications. In some embodiments, the main cutter may have a no-go profile that acts as a final safety factor to avoid pre-mature cutters to be released.

Figure 1B:
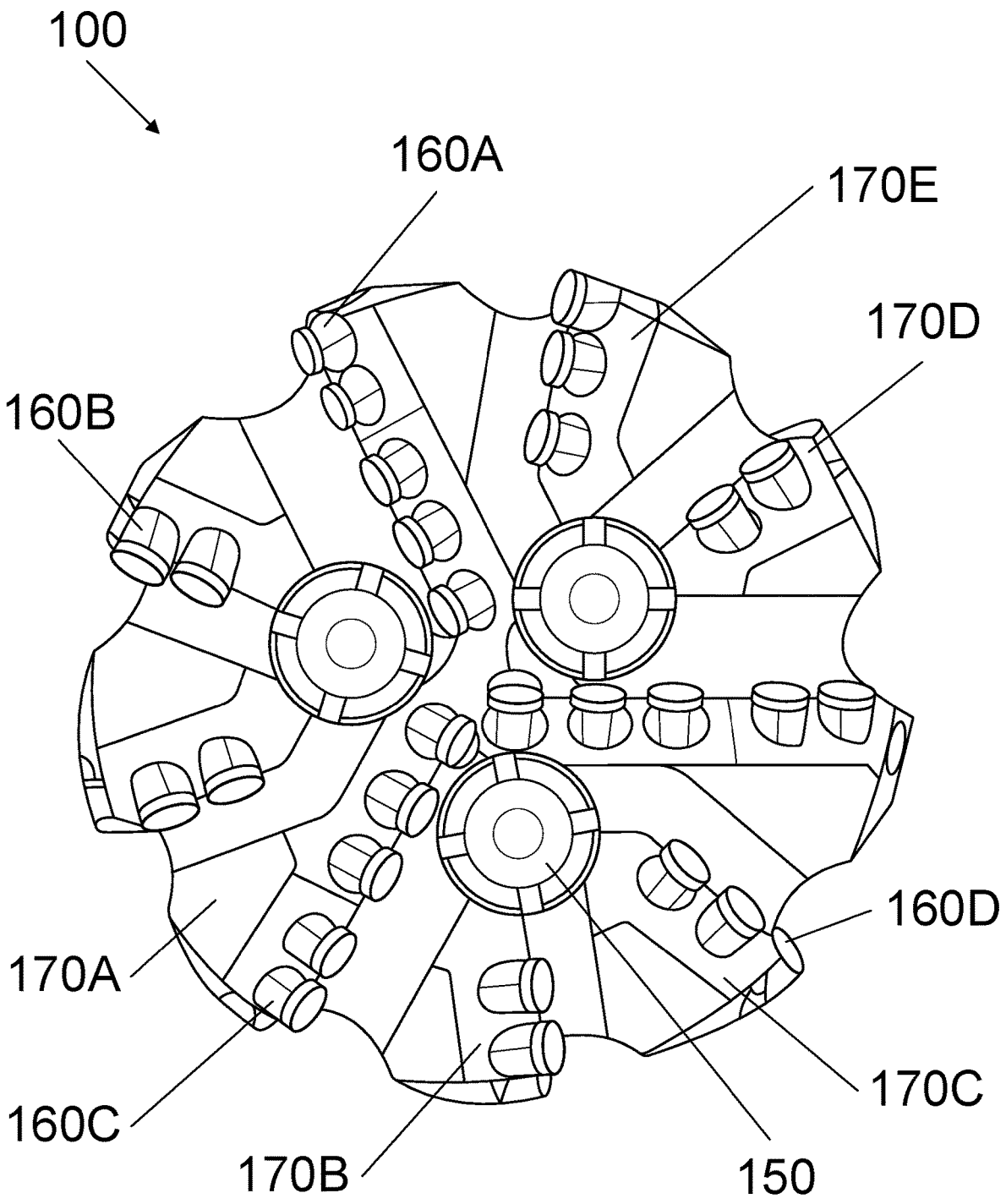

FIGS. 1A and 1B show different views of a drill bit assembly 100 in accordance to one or more embodiments. The drill bit assembly 100 includes a chassis 120 expanding from a pin connection acting as a connecting thread 110, a pin shoulder acting as a drill bit neck 130, and a drill bit body 180. The drill bit assembly 100 is hardware including multiple drill bit devices 170A, 170B, 170C, 170D, and 170E embedded in sockets within the drill bit body 180. Each drill bit device may have various main cutters 160A, 160B, 160C, and 160D disposed on an outer surface of the drill bit body 180. The drill bit neck 130 may include at least one switch port 140 configured to activate or deactivate passage of a predetermined pressure from an internal groove (not shown in these figures) and onto the multiple drill bit devices 170A, 170B, 170C, and 170D. The drill bit body 180 may include multiple spraying nozzles 150A and 150B that are used for improving drilling of the formations.

In one or more embodiments, the drill bit assembly 100 is a tool designed to produce a generally cylindrical hole (wellbore) in the earth's crust by the rotary drilling method for the discovery and extraction of hydrocarbons such as crude oil and natural gas. The hole diameter produced by the drill bit assembly 100 may be between 3.5 inches and 30 inches. The depth of the hole produced may range between 1,000 feet and 30,000 feet. The drill bit assembly 100 is used to break apart subsurface formations by cutting elements of the bit by scraping, grinding, or localized compressive fracturing. The drill bit assembly 100 may be a modified version of a rolling cutter drill bit or a modified version of a fixed cutter drill bit. These drill bits may be modified into the drill bit assembly 100 by carving out space for the drill bit devices and the internal groove. In this regard, rolling cutter bits drill largely by fracturing or crushing the formation with "tooth"-shaped cutting elements on two or more cone-shaped elements that roll across the face of the borehole as the bit is rotated. Further, fixed cutter bits employ a set of blades with very hard cutting elements, most commonly natural or synthetic diamond, to remove material by scraping or grinding action as the bit is rotated.

Regardless of type, the drill bit assembly 100 satisfies two primary design goals: maximize the rate of penetration (ROP) of the formation and provide a long service life. To this end, the drill bit assembly 100 drastically reduces the expenses associated with drilling operations as virtually any type of drill bit may be modified to include the drill bit devices 170A, 170B, 170C, and 170D, which lowers the overall cost of drilling operation as the wellbore would reach a required total depth at a faster rate by avoiding multiple trips from occurring during the drilling operation.

In one or more embodiments, the drill bit assembly 100 may be used in drilling operations including directional technology, where the wellbore is intentionally directed from a vertical direction, which allow the drill bit assembly 100 to be "steered" during drilling operations.

In one or more embodiments, the rolling cutter bits and fixed cutter bits may be modified to have internal passages to direct the predetermined pressure. These internal passages may be different from passages used for circulating drilling fluid, conveyed by the drill pipe from surface pumps, through hydraulic nozzles 150A and 150B directed at the bottom of the wellbore to produce high velocity fluid jets that assist in cleaning the old cuttings off the bottom before the next tooth contacts the rock.

Figure 2:
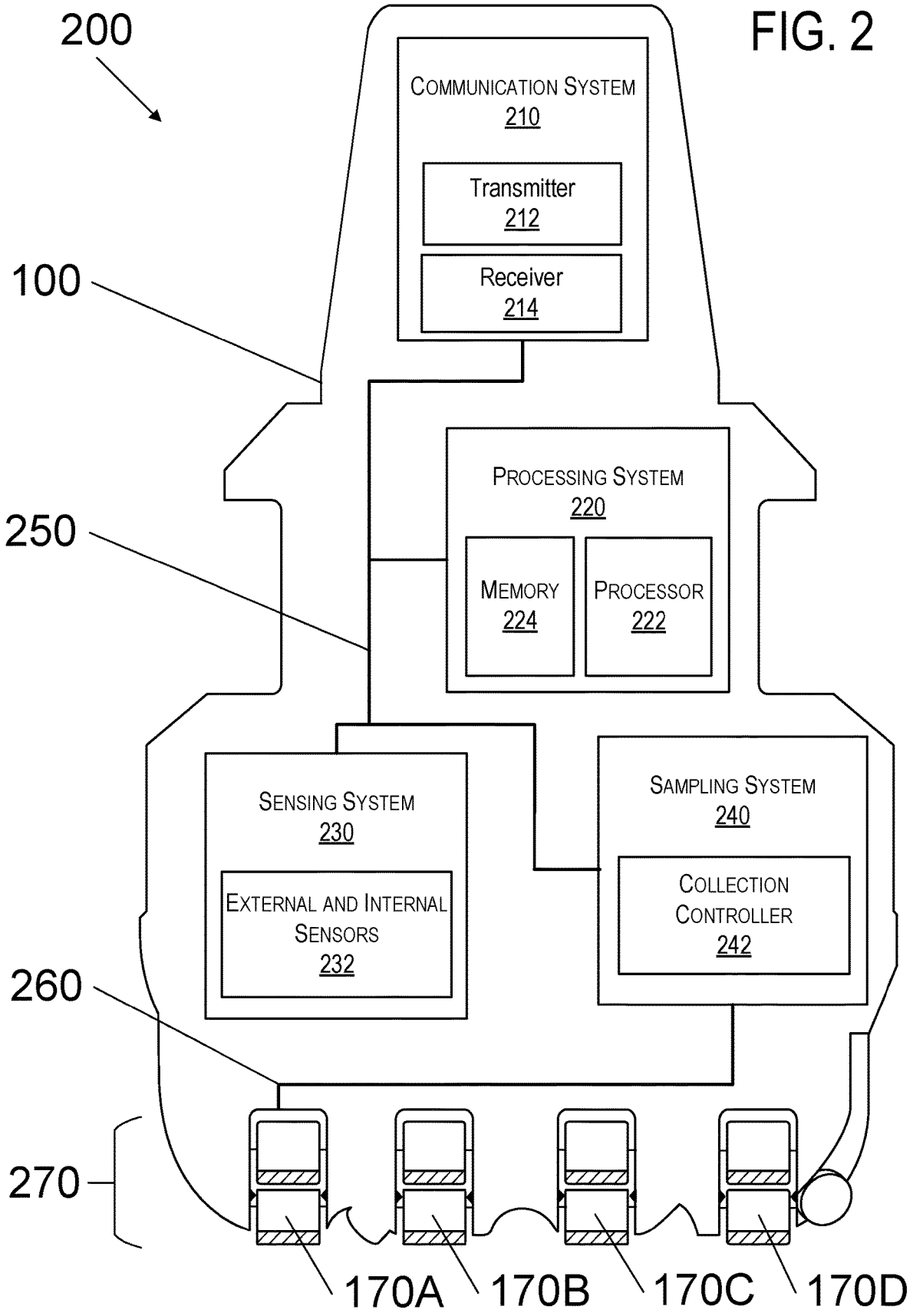
FIG. 2 shows a schematic diagram showing a drill bit device in accordance with one or more embodiments.

FIG. 2 shows a schematic diagram showing at least one drill bit system 200 installed into the drill bit assembly 100. In some embodiments, the drill bit assembly 100 includes electronic components that enable the drill bit system 200 to perform communication functions, data collecting functions, and/or processing functions. In some embodiments, the drill bit system 200 may include a communication system 210, a processing system 220, a sensing system 230, and a sampling system 240 coupled to each other using a hard link 250 and to at least one drill bit device 170A, 170B, 170C, or 170D through a communication link 260. The hard link 250 may be a wired or a wireless connection that is dedicated to transmitting direct signals among the multiple systems. The communication link 260 may be a wired or a wireless connection that is dedicated to transmitting direct signals between the multiple systems and the at least one drill bit device 170A, 170B, 170C, or 170D. In some embodiments, the communication system 210 may include communication devices such as a transmitter 212 and a receiver 214. The transmitter 212 and the receiver 214 may transmit and receive communication signals, respectively. Specifically, the transmitter 212 and the receiver 214 may communicate with one or more control systems located at a remote location through a wired connection. In some embodiments, the communication system 210 may communicate wirelessly with a computing system 1200 located at a remote location away from the rig site.

The processing system 220 may include a processor 222 and a memory 224. The processor 222 may perform computational processes simultaneously and/or sequentially. The processor 222 may determine information to be transmitted and processes to be performed using information received or collected. Similarly, the processor 222 may control collection and exchange of geospatial information relating to the drill bit assembly 100.

The sensing system 230 may include external and internal sensors 232. The external and internal sensors 232 may be sensors that collect physical data from the environment surrounding the drill bit assembly 100 and the immediate surroundings of the drill bit system 200. The external and internal sensors 232 may be lightweight sensors requiring a small footprint. These sensors may exchange information with each other and supply it to the processor 222 for analysis. The external and internal sensors 232 may be logging tools of an electrical type, a nuclear type, a sonic type, or another type. The external and internal sensors 232 may release signals (i.e., electrical, nuclear, or sonic) through a signal generator at a sensing portion. Further, the external and internal sensors 232 may sample physical phenomena occurring in a surrounding space 270 of a corresponding drill bit device 170A, 170B, 170C, or 170D.

The sampling system 240 may include a collection controller 242 that coordinates collection of pressure occurring at the surrounding space 270.

Figure 3B:
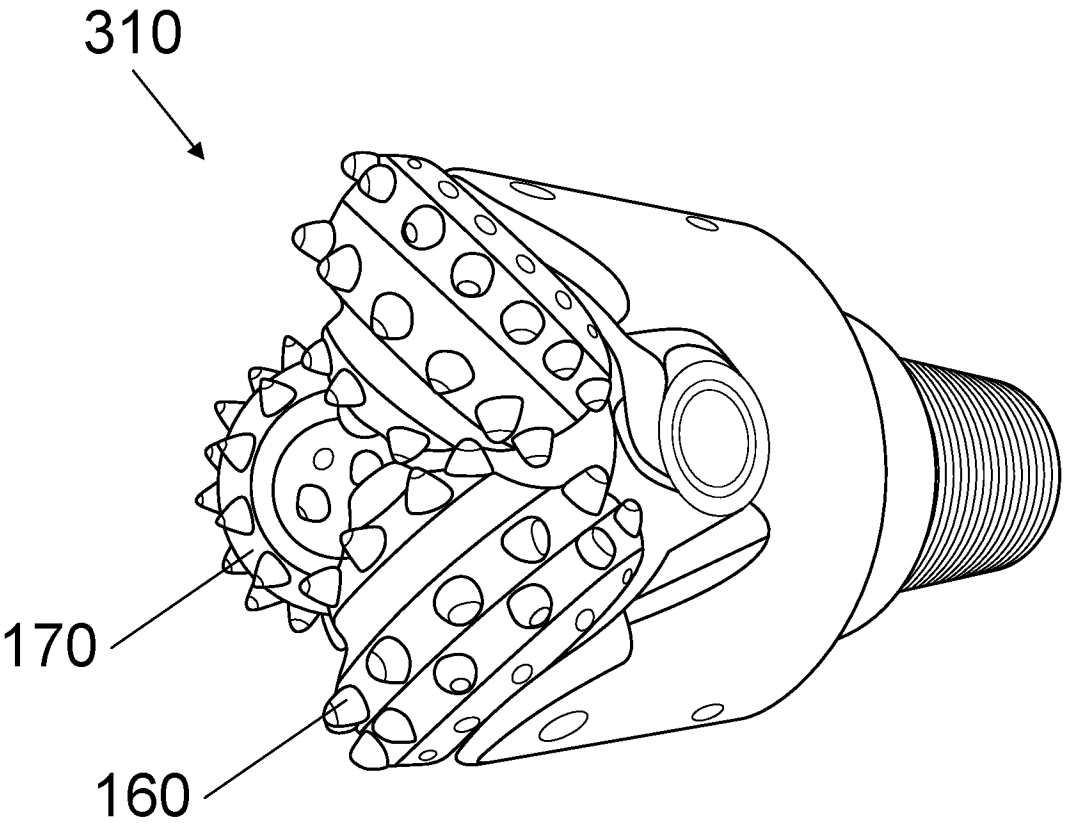
FIGS. 3A-3F show drill bit assemblies in accordance with one or more embodiments.
Figure 3A:
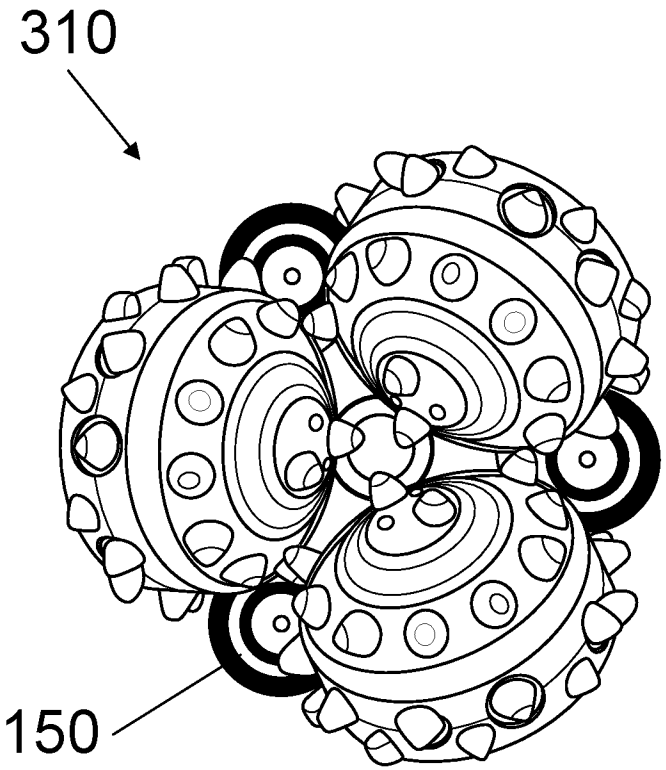
Figure 3D:
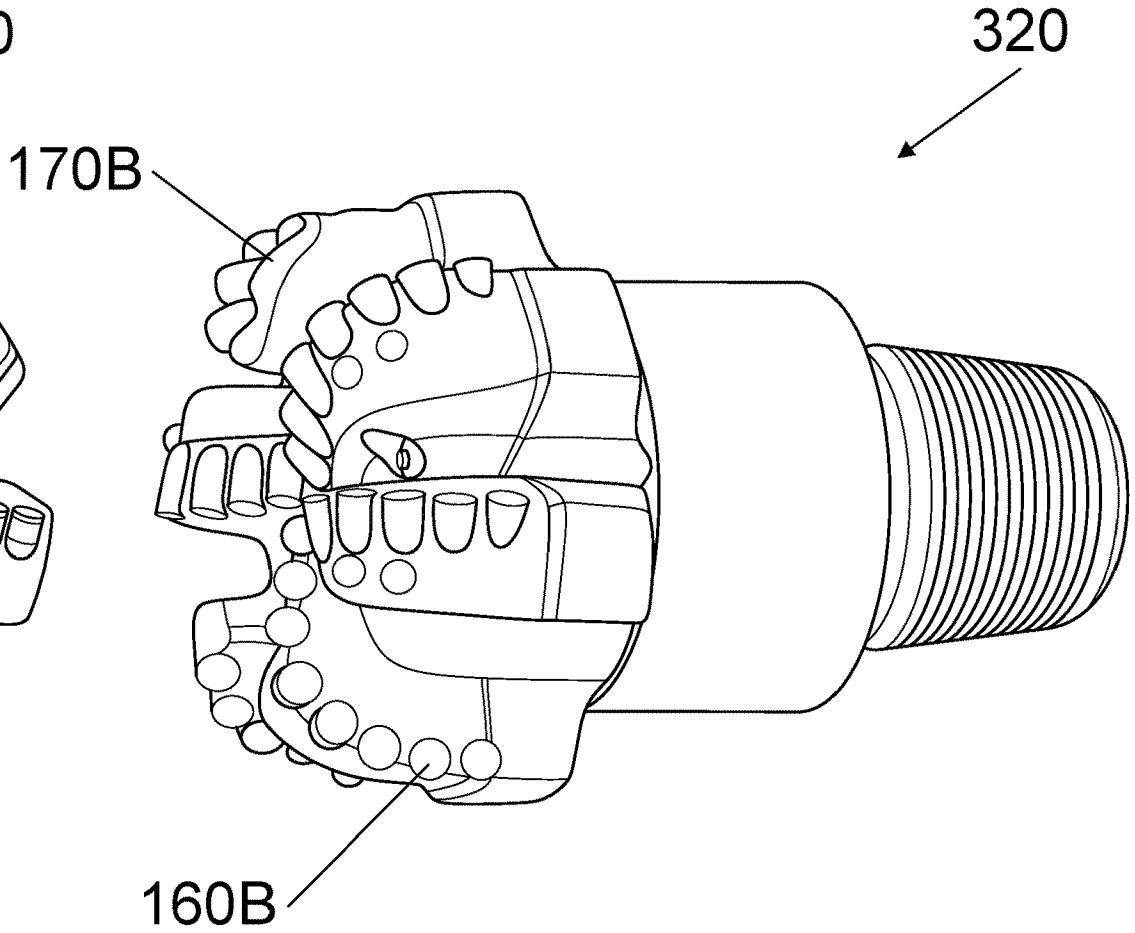
Figure 3C:
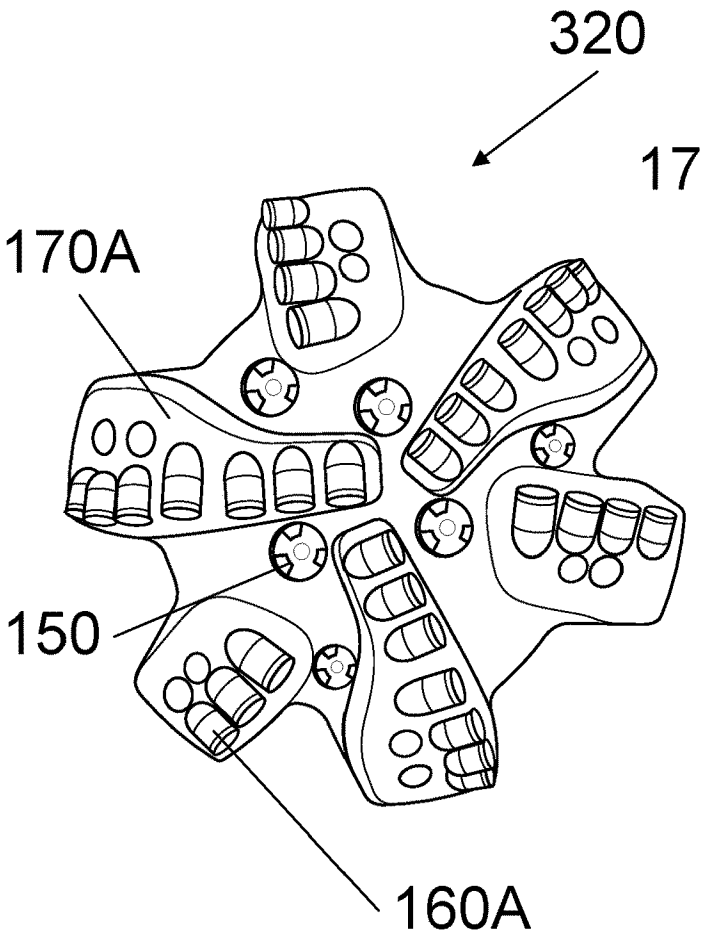
Figure 3F:
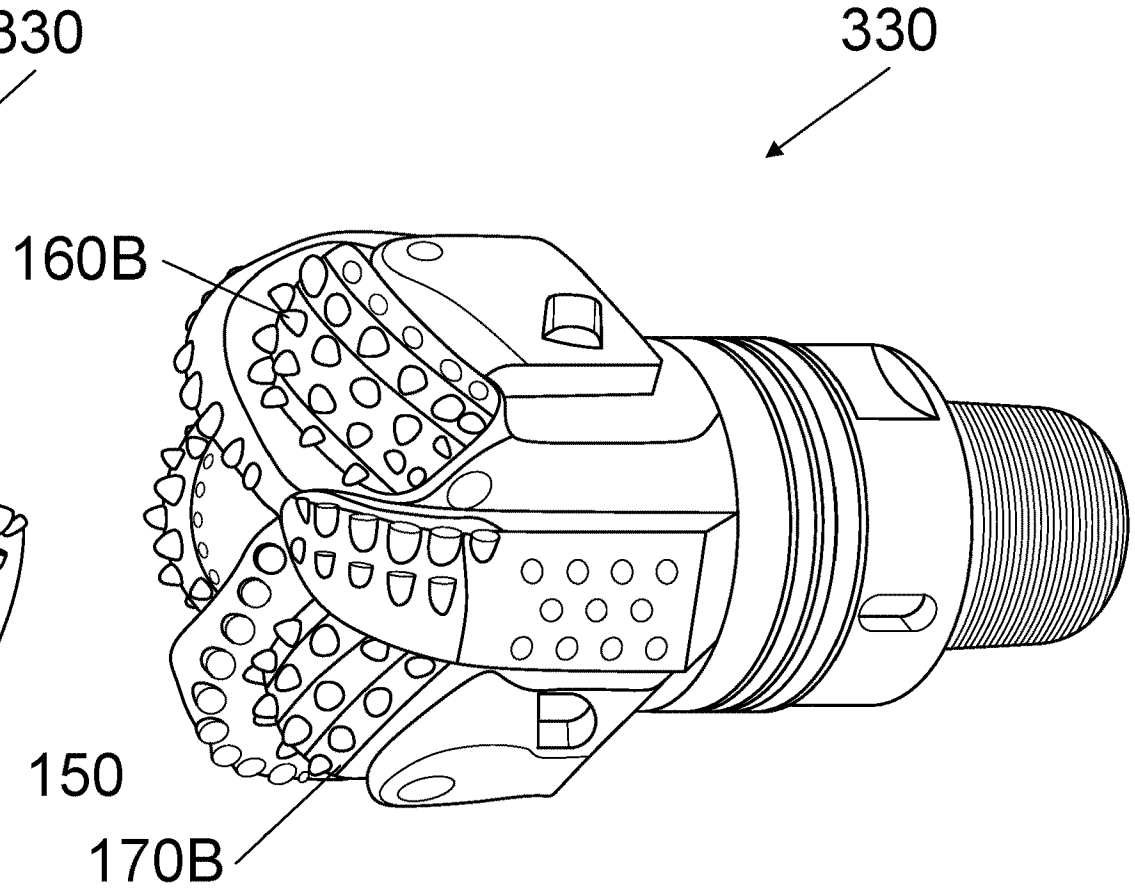
Figure 3E:
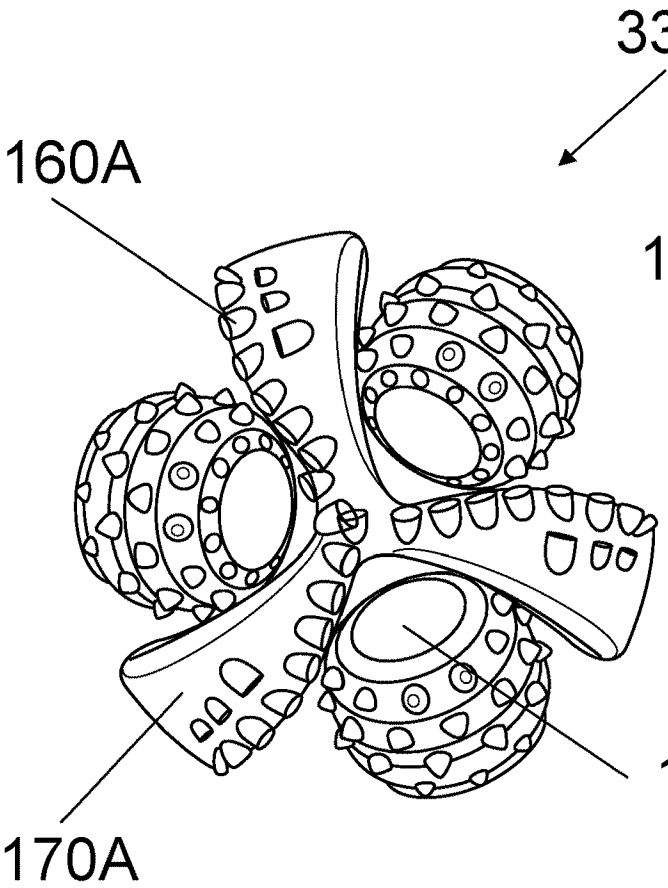

FIGS. 3A, 3B, 3C, 3D, 3E, and 3F show examples of drill bit assemblies 310, 320, and 330. The drill bit assemblies 310, 320, and 330 are drill bits modified to include at least one drill bit device 170. FIGS. 3A and 3B show a drill bit assembly 310 that is a modified tricone roller cone bit. The drill bit assembly 310 includes multiple cutters 160 included in at least one drill bit device 170 and at least one hydraulic nozzle 150. The drill bit assembly 310 includes carbide cutters disposed in a spear point, a nose row, and a heal row. FIGS. 3C and 3D show a drill bit assembly 320 that is a modified Polycrystalline Diamond Compact (PDC) drill bit. The drill bit assembly 320 includes multiple cutters 160A and 160B included in at least one drill bit device 170A and 170B and at least one hydraulic nozzle 150. The drill bit assembly 320 includes diamond cutters disposed in a matrix body bit or a steel body bit. FIGS. 3E and 3F show a drill bit assembly 330 that is a modified Tricone PDC drill bit. The drill bit assembly 330 includes multiple cutters 160A and 160B included in at least one drill bit device 170A and 170B and at least one hydraulic nozzle 150. The drill bit assembly 320 includes carbide cutters and diamond cutters disposed in a matrix body bit or a steel body bit interlaced with a tricone design.

Figure 4A:
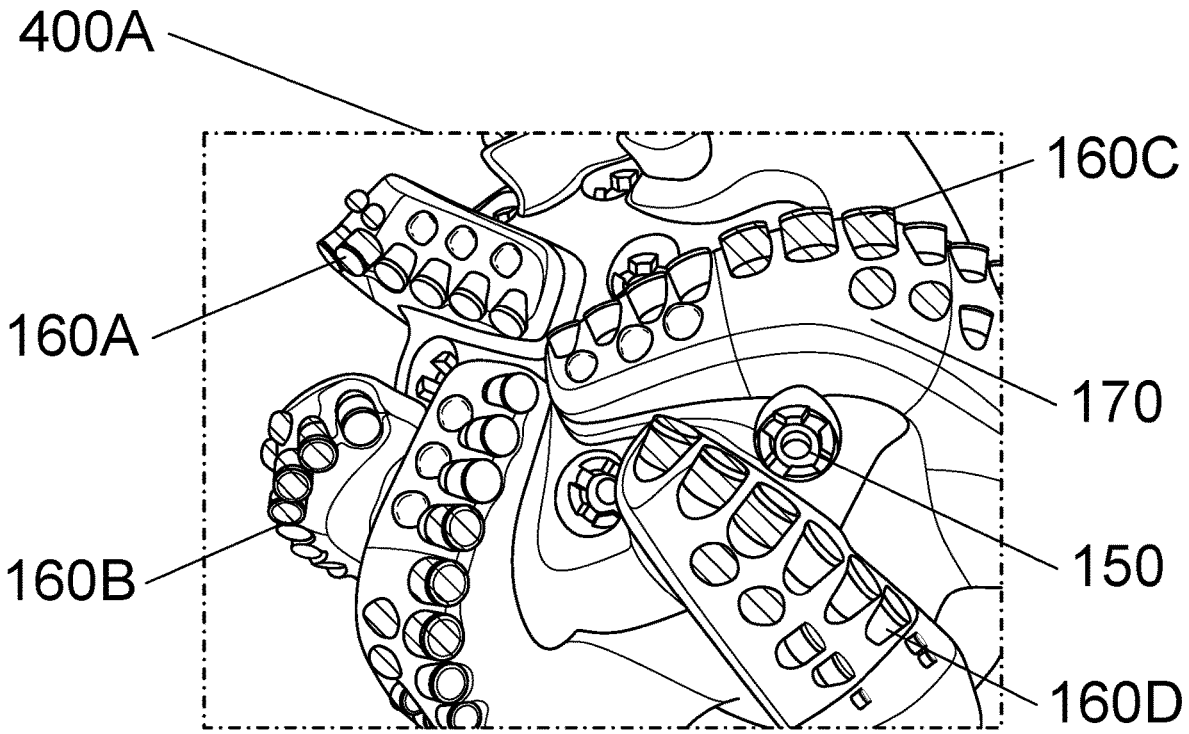
FIGS. 4A and 4B show close-up views of cutters in a drill bit assembly in accordance with one or more embodiments.
Figure 4B:
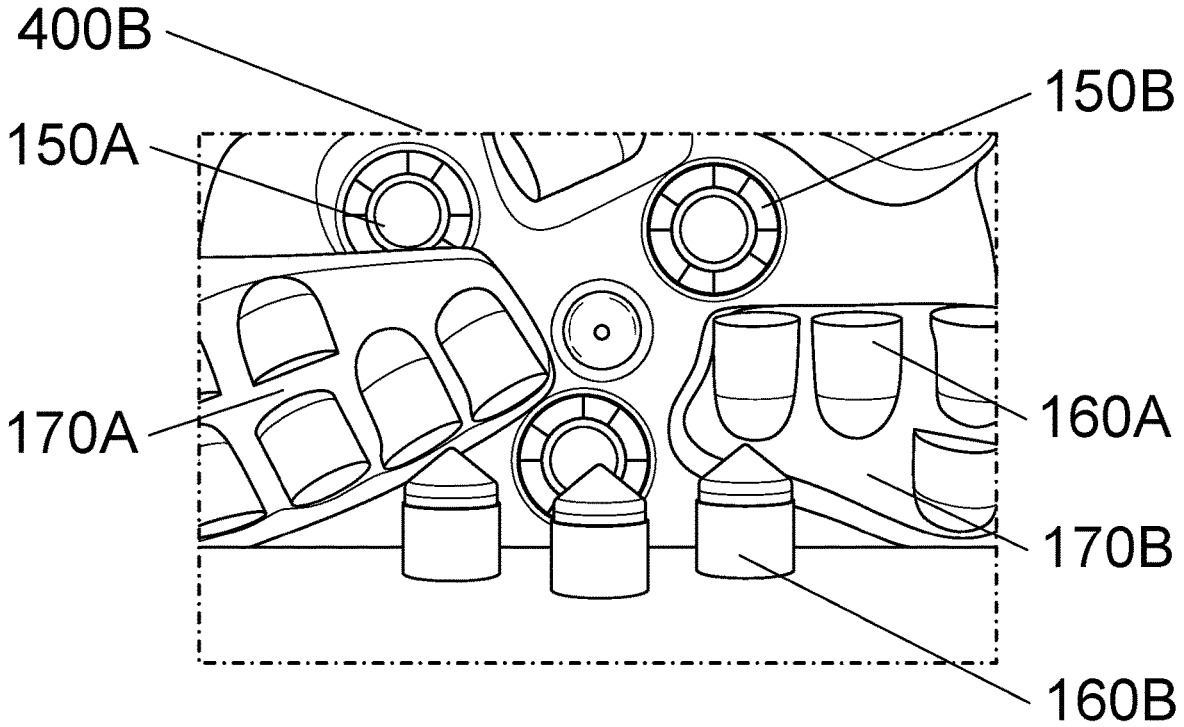

FIGS. 4A and 4B show two close-up images that focus in the position of one or more cutters in a drill bit device 170. FIG. 4A shows an image 400A illustrating five rows of main cutters including cutters 160A-160D disposed in sockets formed by the drill bit device 170 and interposed with at least one nozzle 150 in a modified drill bit assembly. FIG. 4B shows an image 400B illustrating two rows of main cutters including cutters 160A and 160B disposed in sockets formed by the drill bit devices 170A and 170B and interposed with at least nozzles 150A and 150B in a modified drill bit assembly.

Figure 5:
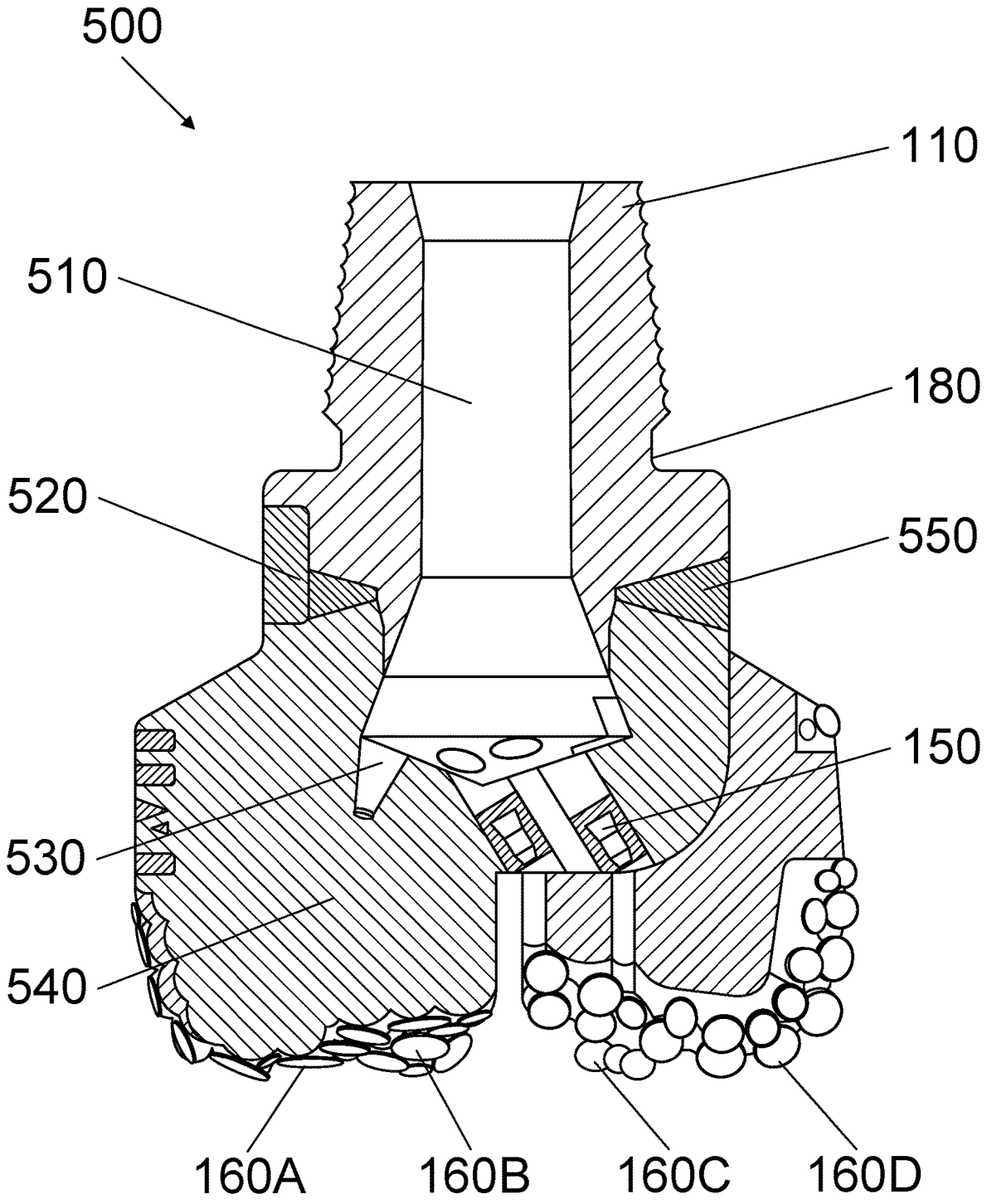
FIG. 5 shows a cross-section view of a drill bit assembly in accordance with one or more embodiments.

FIG. 5 illustrates a drill bit assembly 500 following a PDC bit design. In one or more embodiments, the drill bit assembly 500 is a PDC bit that does not have any moving parts, such as bearings or cones. The drill bit assembly 500 shears the formation while tricone bits crush or gauge the formation. The drill bit assembly 500 allows a cleaning action that is performed by jet nozzles that vary in number and size. The drill bit assembly 500 includes at least one nozzle 150 embedded in the drill bit body 180. As shown in FIG. 5, a cross-section 540 of the drill bit assembly 500 shows a shank bore 510 that allows fluid to flow into the at least one nozzle 150, and the location of the cutters 160A-160D with respect to a breaker shot 520, interchangeable bore 530, and weld grooves 550.

Figure 6A:
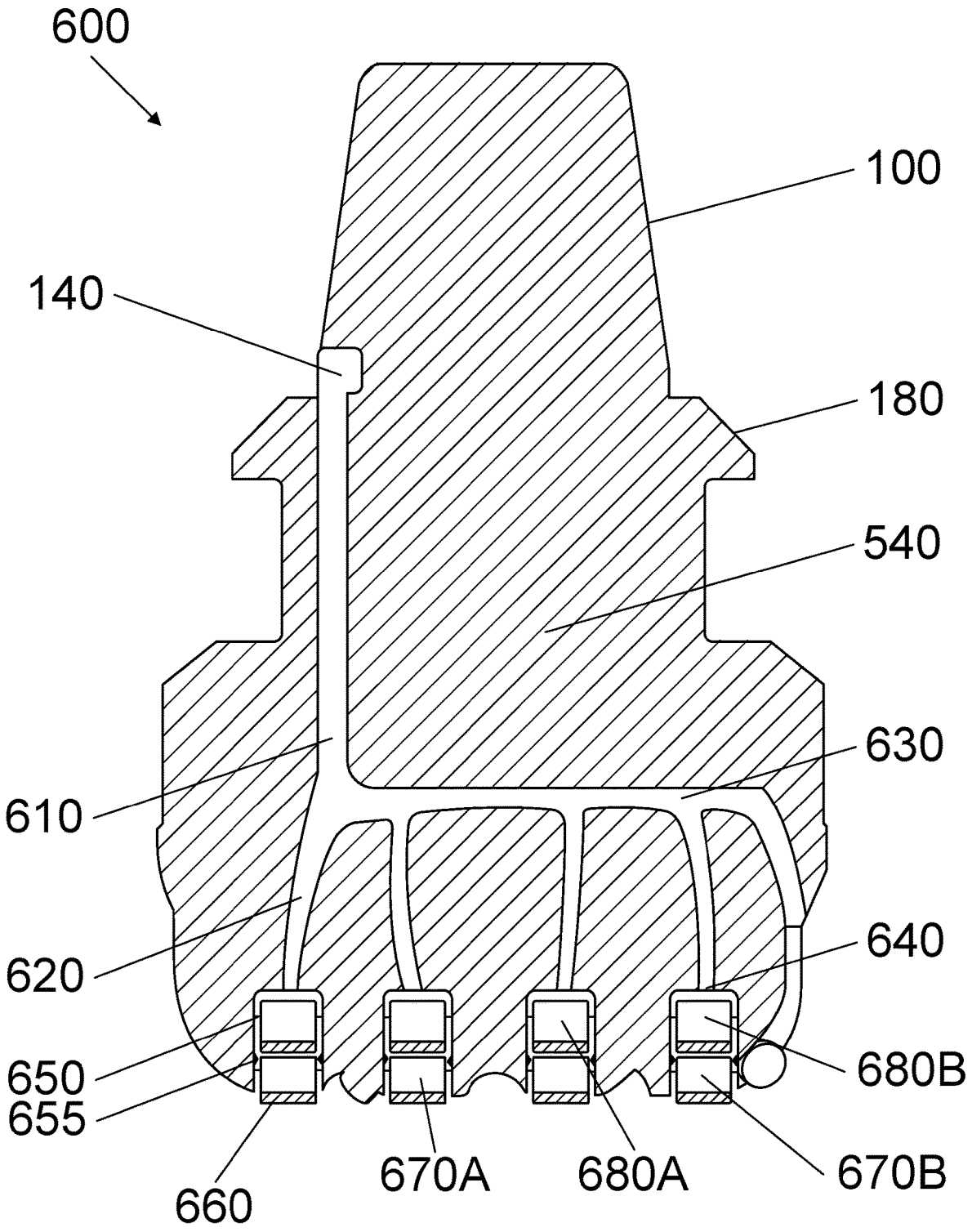
FIGS. 6A-6F show schematic diagrams illustrating examples of cutters being released from various drill bit devices.

FIGS. 6A, 6B, 6C, 6D, 6E, and 6F show a cross-section view 600 of a drill bit assembly 100 that releases one or more cutters out of multiple drill bit devices in accordance to one or more embodiments. As seen in FIG. 6A, the cross-section view 600 includes a clear view of the internal channels for the movement of pressure from a switch port 140 to multiple drill bit devices embedded in the drill bit body 180. In cross-section view 600, the switch port 140 is directly connected to an internal groove 610 that distributes a predetermined pressure to multiple device grooves 620 using a common groove 630. In the cross-section 540, the multiple grooves connect the switch port 140 to multiple gates 640. The gates 540 are a connection point between the grooves and each drill bit device 660. Each drill bit device 660 includes at least one main cutter 670A and 670B and at least one pre-charged cutter 680A and 680B disposed directly behind main cutters. The main cutters 670A and 670B and the pre-charged cutters 680A and 680B may be secured in place using shear pins 650. The shear pins 650 may be rated at different ratings so they are released using different pressure amounts. In some embodiments, the cross-section view 600 shows a no-go profile located at the bottom of each main cutter.

Figure 6B:
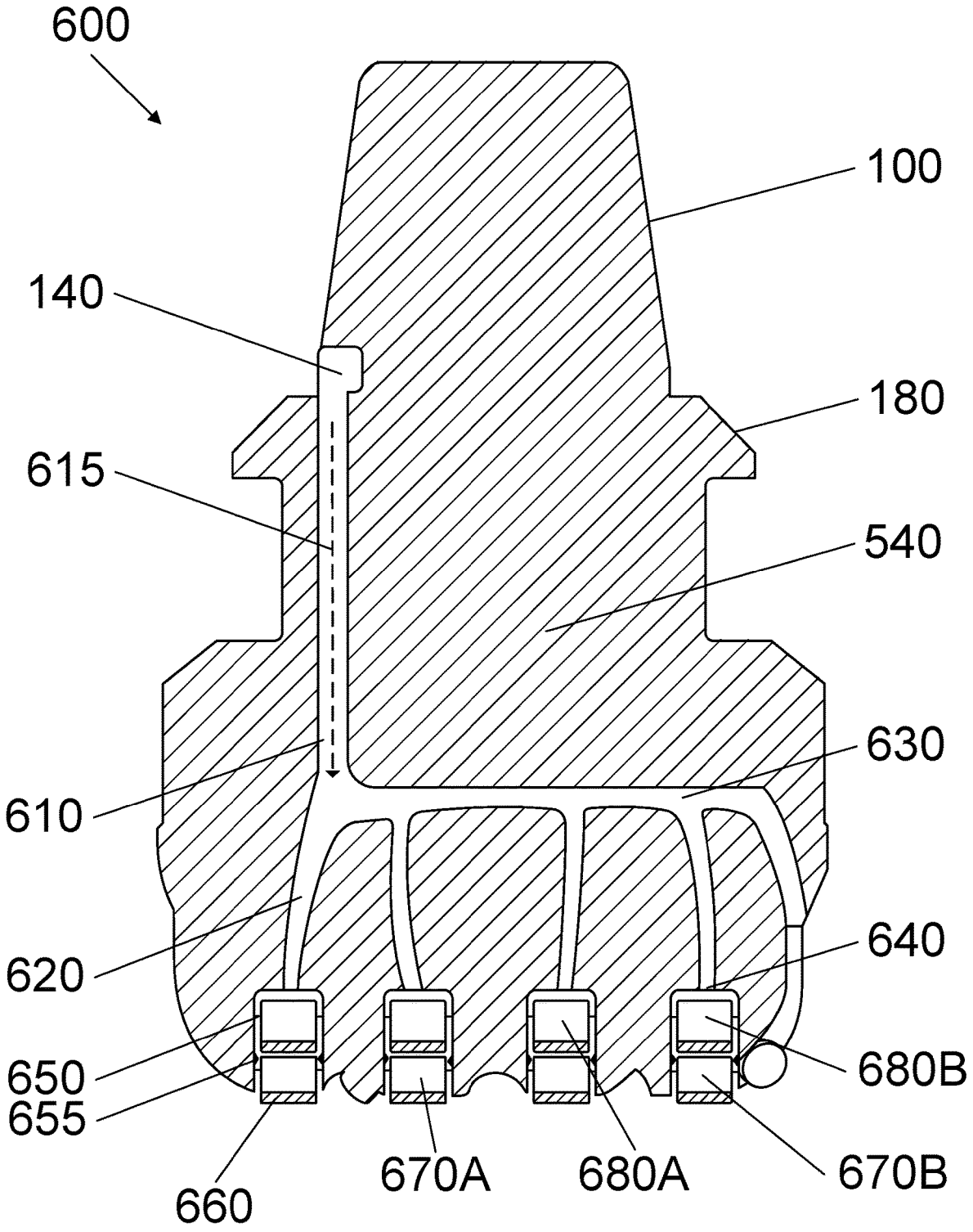
Figure 6C:
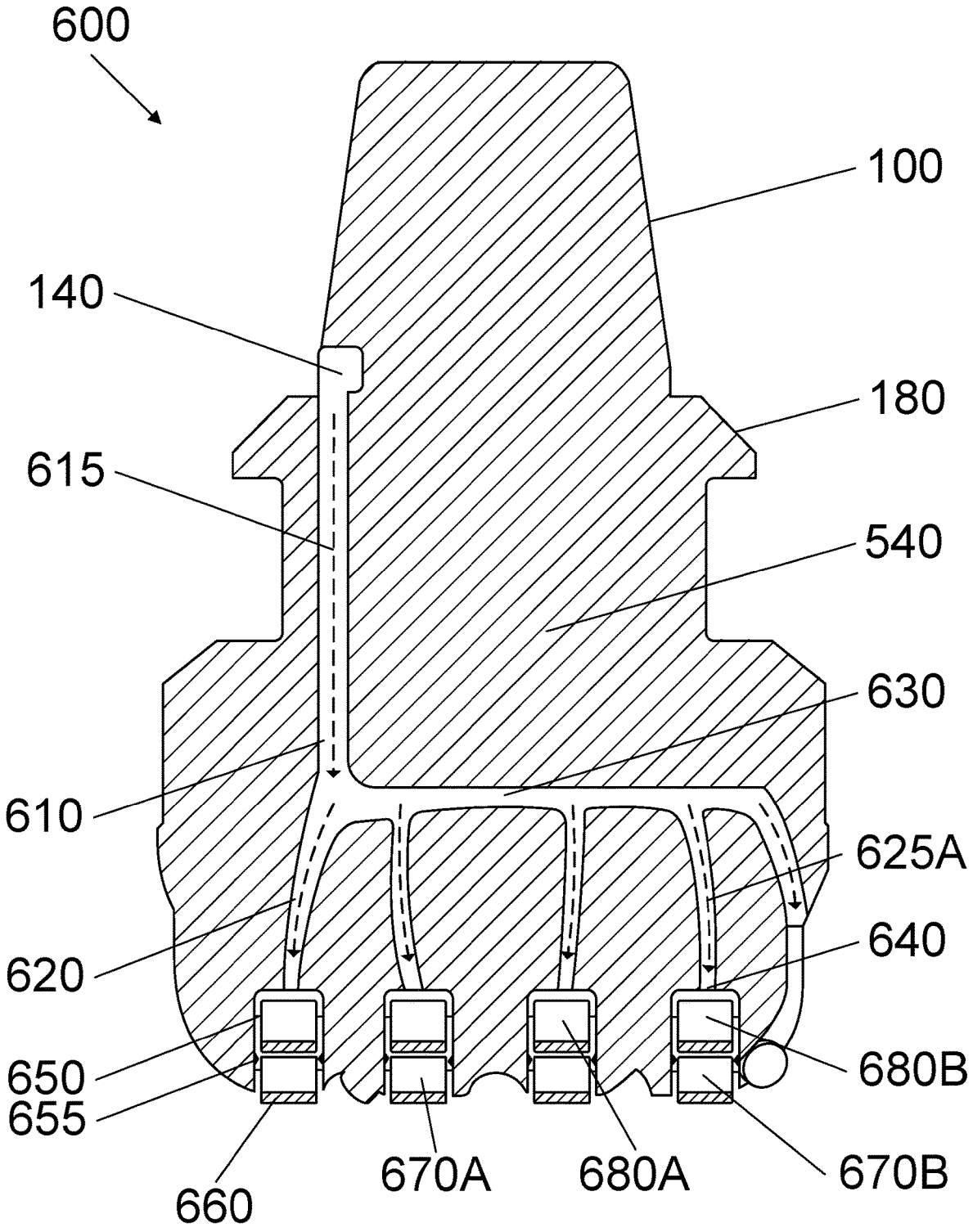
Figure 6D:
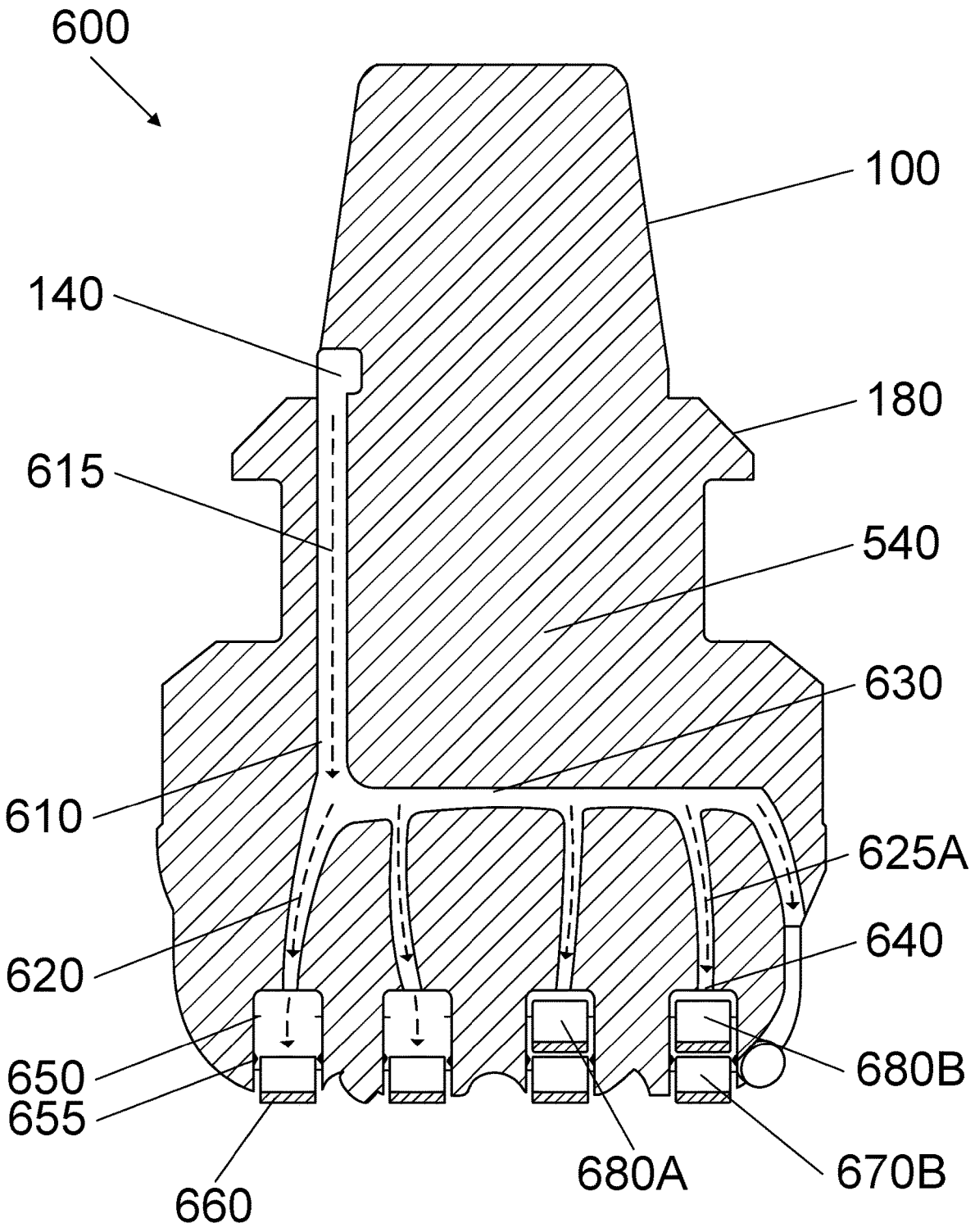
Figure 6E:
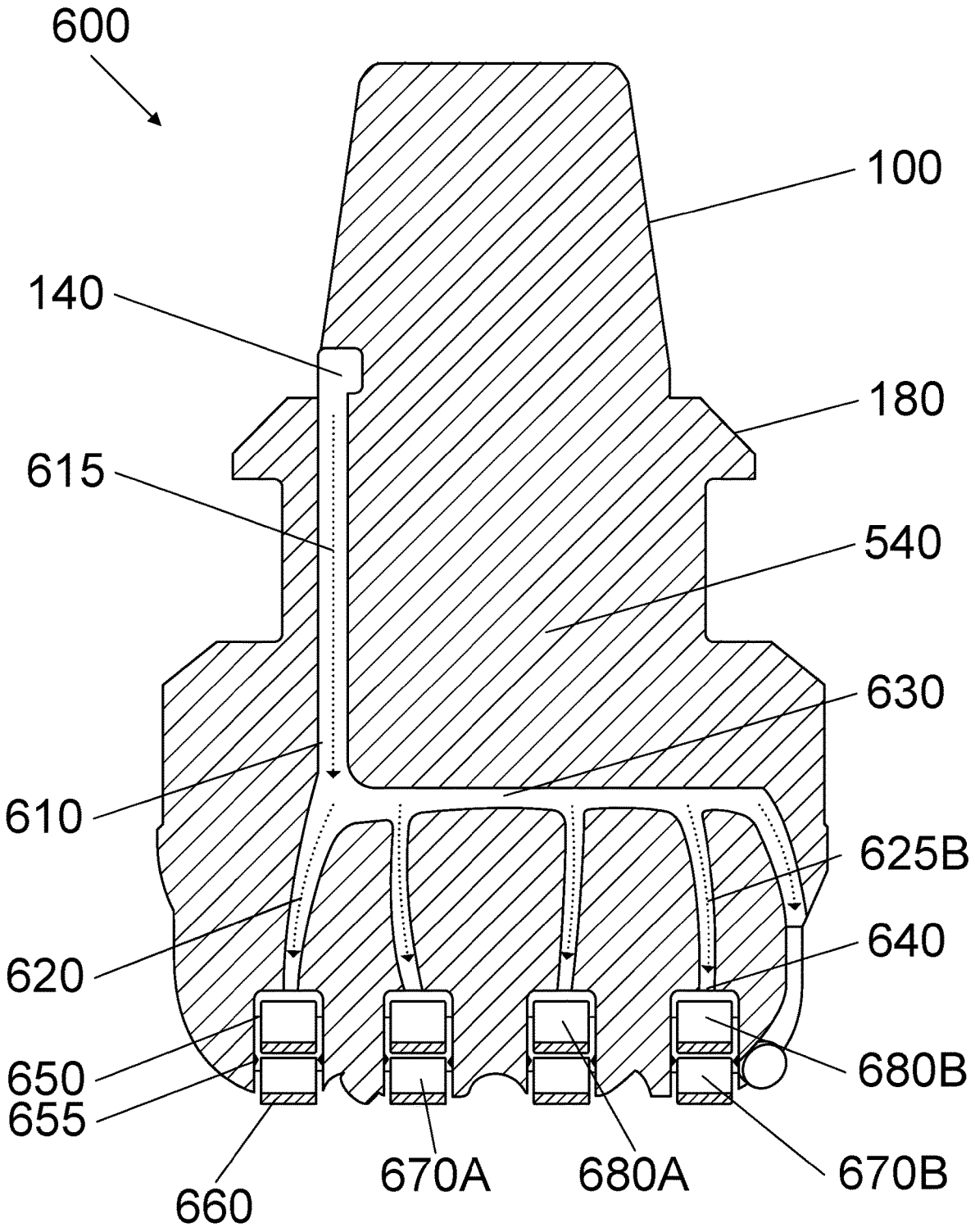
Figure 6F:
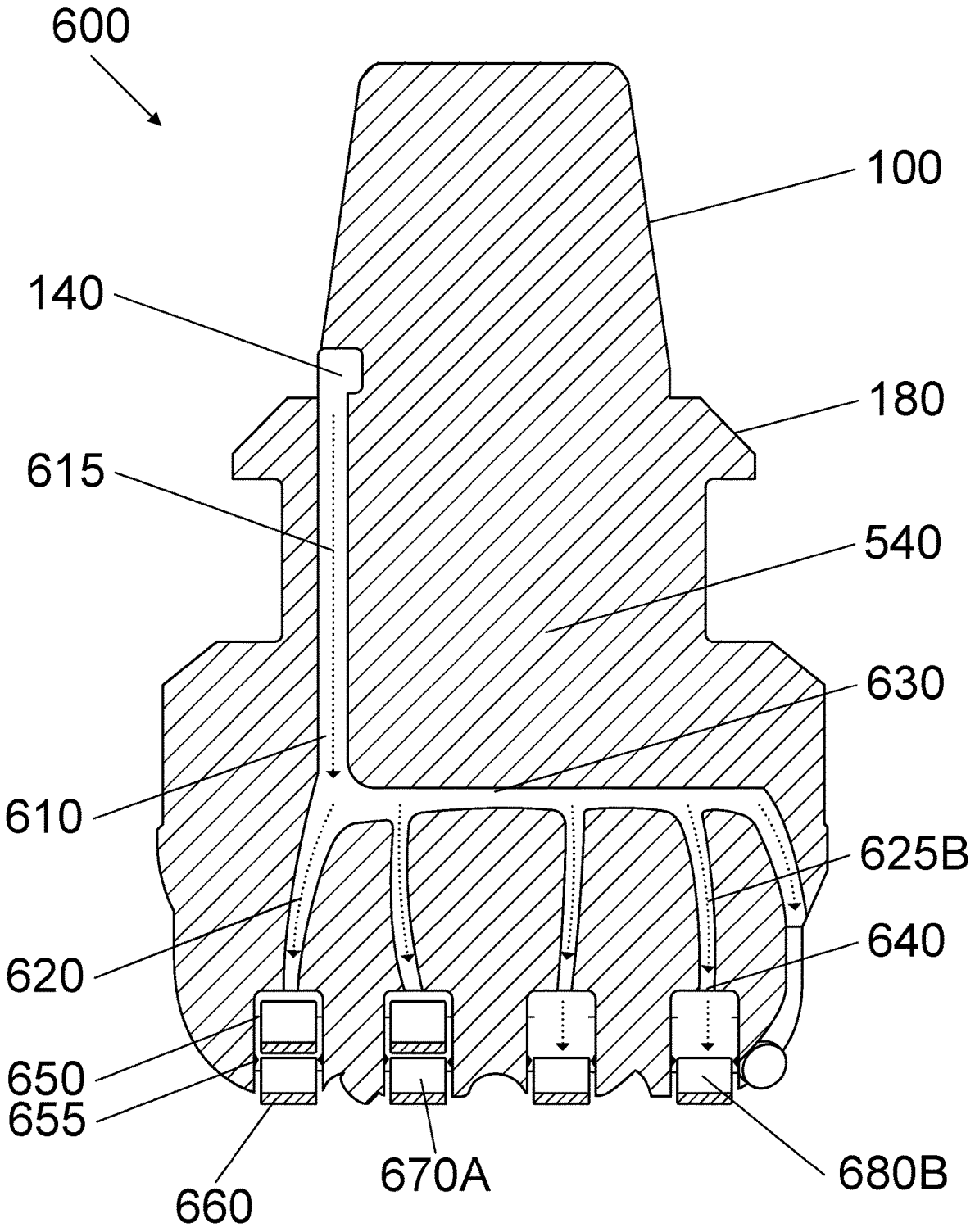

As shown in FIG. 6B, a predetermined pressure 615 may be released after the switch port 140 has been activated. As seen in FIGS. 6C and 6D, the predetermined pressure 615 causes a set of main cutters 670A out of all the main cutters 670A and 670B to be released out of a cutter housing of their respective drill bit device 660 and causes a set of pre-charged cutters out of all the pre-charged cutters 680A and 680B to move onto the outermost surface of the cutter housing. As seen in FIGS. 6E and 6F, the predetermined pressure 615 causes another set of main cutters 670B out of all the main cutters 670A and 670B to be released out of another cutter housing of their respective drill bit device 660 and causes another set of pre-charged cutters 680A and 680B out of all the pre-charged cutters 680A and 680B to move onto the outermost surface of the cutter housing.

In some embodiments, the gate 640 is configured to compare the predetermined pressure 615 to a threshold. The threshold may be set as a function of the aperture and the length of specific device grooves. In some embodiments, the threshold is a predetermined pressure value that is monitored by one or more of the external and internal sensors 232. The predetermined pressure may be a first type of pressure or a second type of pressure. The predetermined pressure may be the first type of pressure when the predetermined pressure is smaller than the threshold. The predetermined pressure may be the second type of pressure when the predetermined pressure is equal or larger than the threshold. In some embodiments, the predetermined pressure is only allowed into the cutter housing when the predetermined pressure is the second type of pressure. For example, as shown in FIGS. 6C and 6D, in an event of a predetermined pressure of a first type 625A, the respective gates 640 determines that only certain main cutters, such as main cutters 670A, may be released. As a result, pre-charged cutters may move to replace the released main cutters. Similarly, as shown in FIGS. 6E and 6F, in an event of a predetermined pressure of a second type 625B, the respective gates 640 determines that only certain main cutters, such as main cutters 670B, may be released. As a result, pre-charged cutters, such as pre-charged cutters 680A and 680B may move to replace the released main cutters.

In one or more embodiments, the shear pins 650 are short pieces of brass or steel that are used to retain the main cutters 670A and 670B and the pre-charged cutters 680A and 680B in a fixed position. The drill bit device 660 may include the no-go profile 655 that incorporates a reduced diameter internal profile and that provides a positive indication of seating by preventing each main cutter out of the various main cutters to be set from passing through in the direction of the drill bit body 180. In some embodiments, the no-go profile 655 is a safety that prevents the main cutters from dropping or releasing prematurely in an outward direction. In some embodiments, the shear pins are attachments of different ratings that allow a selective drop or release of one or more cutters out of the multiple of main cutters. The pre-charged cutters are attached using the shear pins as attachments of different ratings to allow a selective drop or release of one or more cutters out of the multiple of pre-charged cutters.

Figure 7:
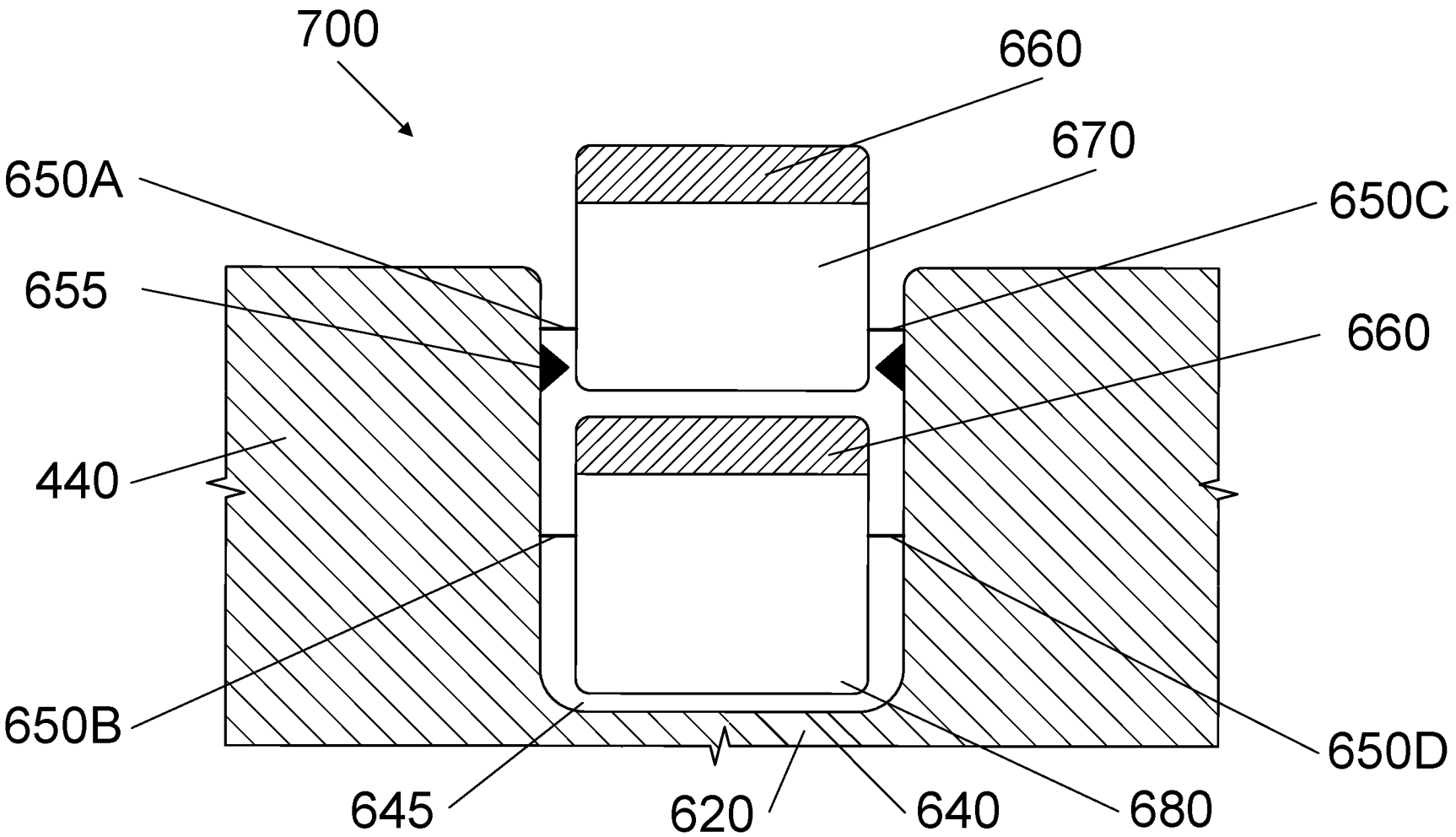
FIG. 7 shows a cross-section view of a drill bit device in accordance to one or more embodiments.

FIG. 7 shows a schematic diagram for an example in accordance with one or more embodiments. In one or more embodiments, a cross-section shows a cutter housing 700 containing main cutters 670 located at an outermost surface 440 of a drill bit device. The cross-section shows the cutter housing 700 containing pre-charged cutters 680 located immediately behind the main cutters 670 in an inner space 645 of the drill bit device. The cross-section shows shear pins 650A-650D holding the multiple cutters and a no-go profile 655 disposed as an emergency stop if the shear pins 650A and 650B fail. The cross-section shows that the sharp edge 660 may be the same for both the main cutters 670 and the pre-charged cutters 680. In the cross-section, the gate 640 is shown disposed between the device groove 620 and the inner space 645.

Figure 8:
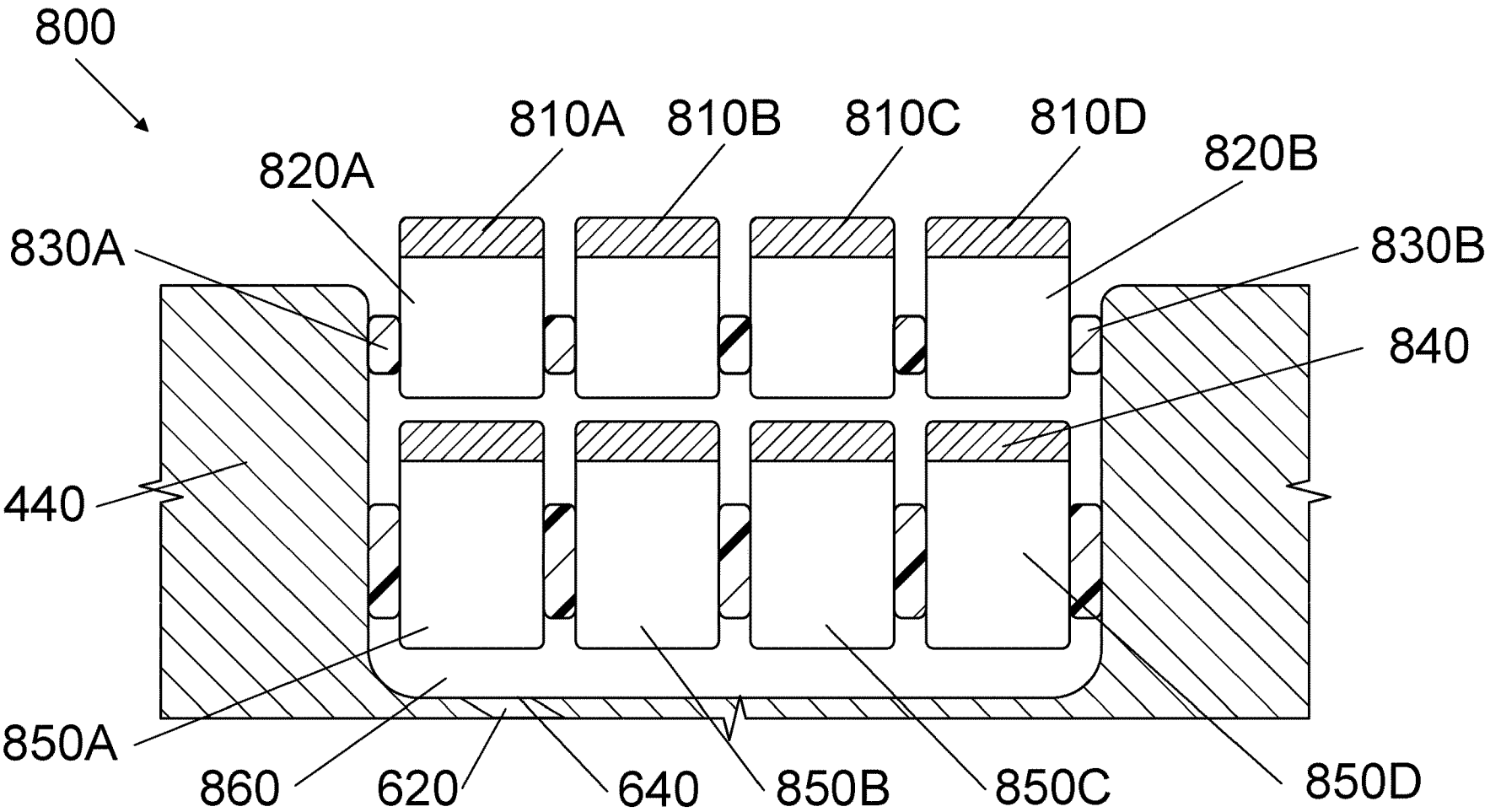
FIG. 8 shows a cross-section view of a drill bit device in accordance to one or more embodiments.

FIG. 8 shows a schematic diagram for an example in accordance with one or more embodiments. In one or more embodiments, a cross-section shows a socket 800 acting as a cutter housing containing main cutters 820A and 820B located at an outermost surface 440 of a drill bit device. The cross-section shows the socket 800 containing pre-charged cutters 850A-850D located immediately behind the main cutters 820A and 820B in an inner space 860 of the drill bit device. The cross-section shows rubber attachments 830A-830D holding the multiple cutters against each other and against the walls of the socket 800. The cross-section shows that the sharp edges 810A-810D may be equal for all main cutters 820A and 820B. The cross-section shows that the sharp edges 840 may be equal for all main cutters 850A-850D. In the cross-section, the gate 640 is shown disposed between the device groove 620 and the inner space 860.

Figure 9:
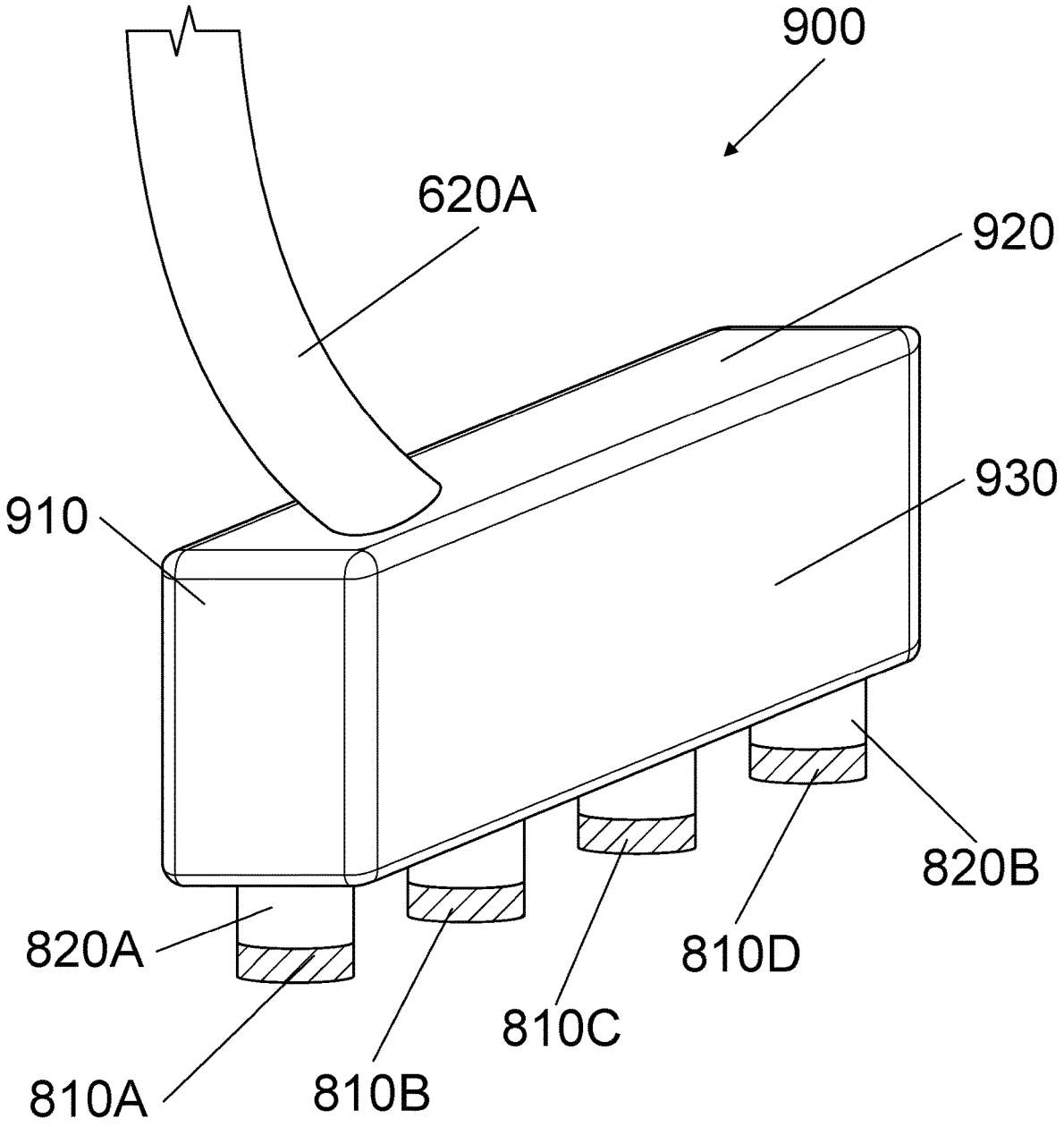
FIG. 9 shows a drill bit device in accordance to one or more embodiments.
Figure 10:
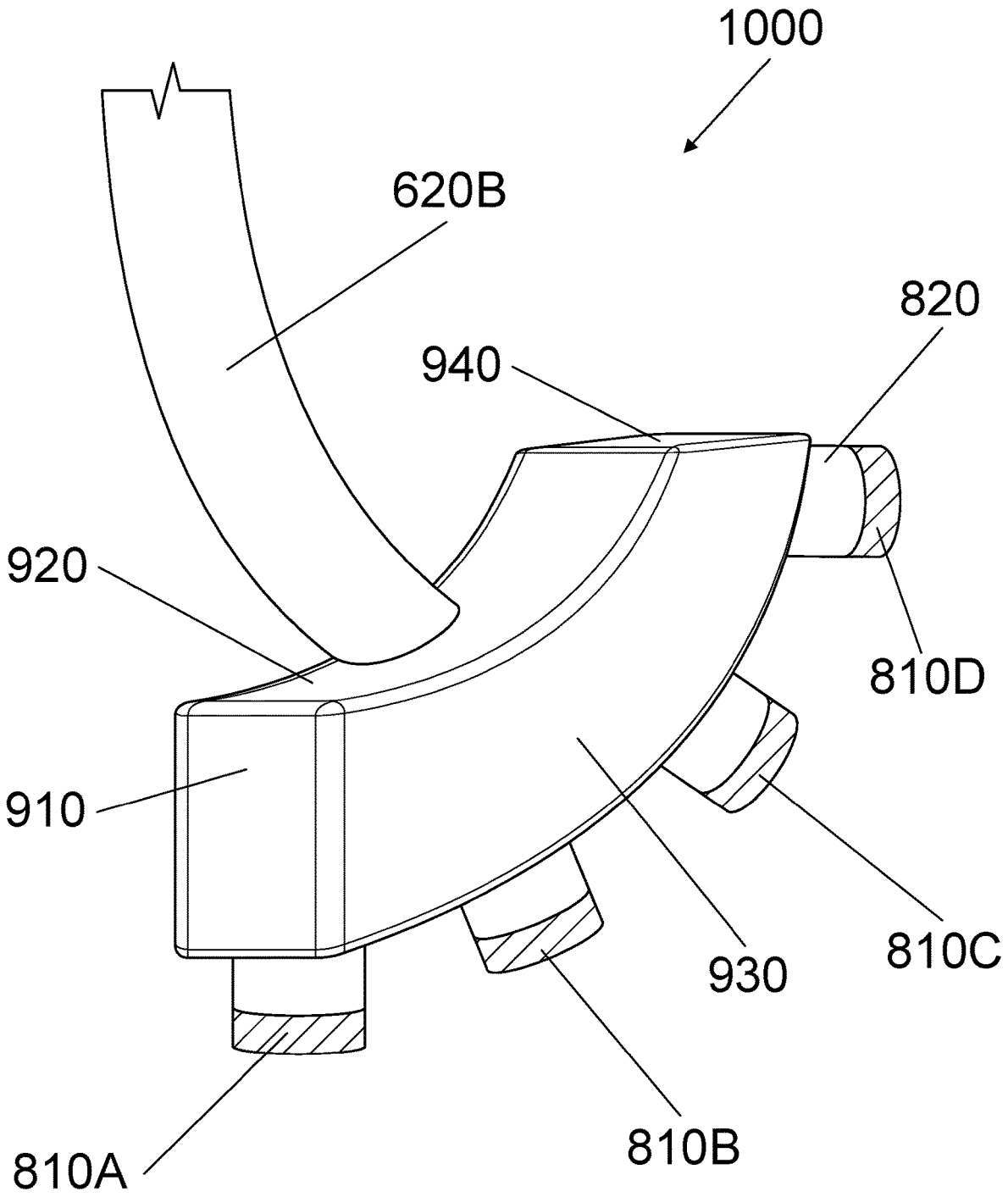
FIG. 10 shows a cross-section view of a drill bit device in accordance to one or more embodiments.

FIGS. 9 and 10 show a straight socket 900 and a curved socket 1000, respectively. The straight socket 900 may be a drill bit device including any number of main cutters 820A and 820B and connected to a device groove 620A. FIG. 9 shows four main cutters 820A and 820B that include an equal number of pre-charged cutters (not shown in this figure). The straight socket 900 may be limited by multiple walls 910-930. In some embodiments, the multiple walls 910, 920, and 930 are walls disposed in the inside of the drill bit body 180. The curved socket 1000 may be a drill bit device including any number of main cutters 820 and connected to a device groove 620B. FIG. 10 shows four main cutters 820 that include an equal number of pre-charged cutters (not shown in this figure). The curved socket 1000 may be limited by multiple walls 910, 920, 930, and 940. In some embodiments, the multiple walls 910-940 are walls disposed in the inside of the drill bit body 180.

Figure 11:
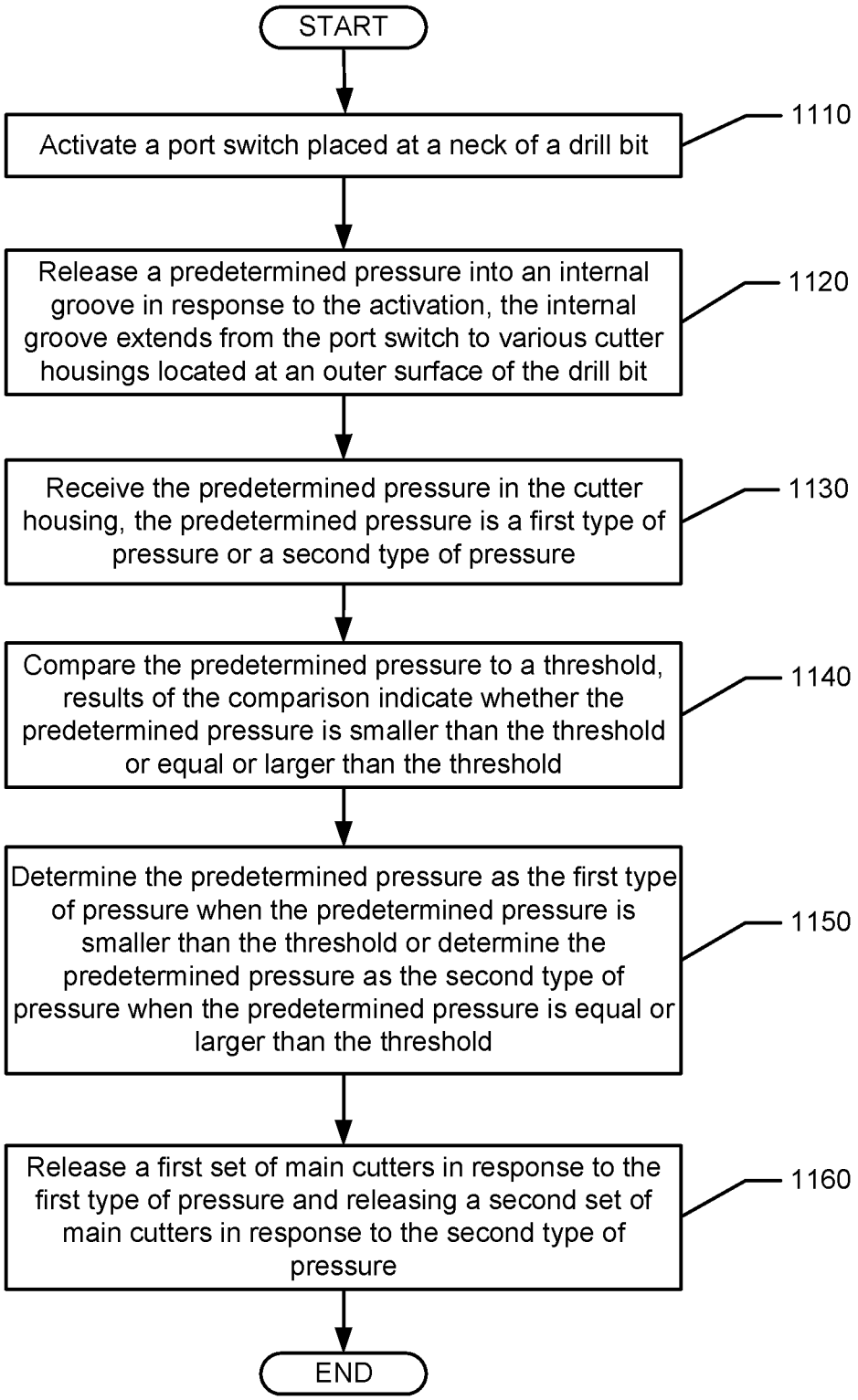
FIG. 11 shows a flowchart in accordance with one or more embodiments.

FIG. 11 shows a flowchart in accordance with one or more embodiments.

Specifically, FIG. 11 describes a method for releasing cutters on the fly. In some embodiments, the method may be implemented using the processor 222 of the drill bit device 170 described in reference to FIGS. 1A-3. Further, one or more blocks in FIG. 11 may be performed by one or more components as described in FIGS. 1A-3. While the various blocks in FIG. 11 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 1110, the port switch 140 is activated. The port switch 140 is placed at a neck of a drill bit. The activation of the port switch 140 triggers hardware and software devices that start monitoring of one or more cutters located on an outer surface of the drill bit body 180 of the drill bit assembly 100. Upon activation of the port switch 140, the sensing system 230 coordinates information collected by the sampling system 240 to determine internal pressures in the cutter housing 700 of a given drill bit device 170. The sensing system 230 establishes a base pressure that works as a standard pressure or a underlying pressure of the cutter housing 700.

In Block 1120, the predetermined pressure is released into the internal groove 610 in response to the activation. The internal groove 610 extends from the port switch 140 to various cutter housings located at an outer surface of the drill bit. The predetermined pressure may be pre-stored in the port switch 140 or it may be allowed to be transferred in a controller manner using a stand-pipe pressure open system inside the drill bit device 170 through the port switch 140.

In Block 1130, the predetermined pressure is received in the cutter housing, the predetermined pressure is a first type of pressure or a second type of pressure. The port switch 140 may be configured for handling multiple profiles associated to multiple pressures. The multiple pressures allow for specific pressures to be delivered through the internal groove 160. In this regard, the port switch 140 is rated to accept specific pressures into the internal groove 160.

In Block 1140, the processor 222 compares the predetermined pressure to a threshold. The results of the comparison indicate whether the predetermined pressure is smaller than the threshold or equal or larger than the threshold. The processing system 220 controls all information retrieved and relayed by the sensing system 230. The sensing system 230, as explained in reference to FIG. 2, may perform selective transmission of the pressure in the cutter housing 700 to a surface panel on a surface area. To this end, the sensing system 230 may perform this transmission using a communication system 210.

In Block 1150, the gate 640 determines the predetermined pressure as the first type of pressure when the predetermined pressure is smaller than the threshold or determine the predetermined pressure as the second type of pressure when the predetermined pressure is equal or larger than the threshold. Any pressure may be regulated through the port switch 140.

In Block 1160, the drill bit device 170 releases a first set of main cutters in response to the first type of pressure and releases a second set of main cutters in response to the second type of pressure. The type of cutters may be installed in the order of the release such that a mixture of cutter types (i.e., associated to different pressures), may be installed in a single cutter housing 700.

Embodiments of the invention may be implemented using virtually any type of computing system, regardless of the platform being used. In some embodiments, the systems described in FIG. 2 may be connected to a computer system 1200 located at a remote location such that data collected is processed away from the surface. In some embodiments, the computing system may be implemented on remote or hand-held devices (e.g., laptop computer, smart phone, personal digital assistant, tablet computer, or other mobile device), desktop computers, servers, blades in a server chassis, or any other type of computing device or devices that includes at least the minimum processing power, memory, and input and output device(s) to perform one or more embodiments of the invention.

Figure 12:
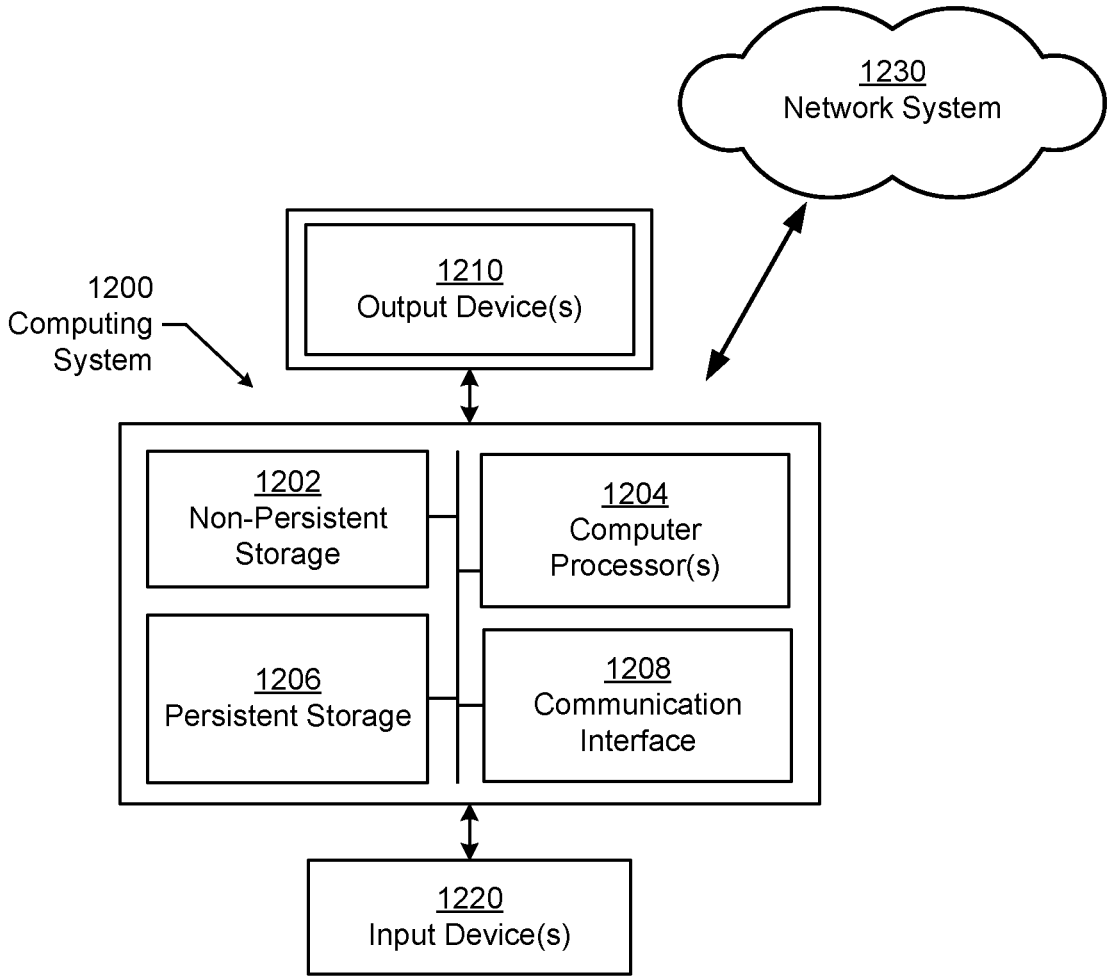
FIG. 12 shows a computer system for releasing cutters in a drill bit in accordance with one or more embodiments.

As shown in FIG. 12, the computing system 1200 may include one or more computer processor(s) 1204, non-persistent storage 1202 (e.g., random access memory (RAM), cache memory, or flash memory), one or more persistent storage 1206 (e.g., a hard disk), and numerous other elements and functionalities. The computer processor (s) 1204 may be an integrated circuit for processing instructions. The computing system 1200 may also include one or more input device(s) 1220, such as a touchscreen, keyboard, mouse, microphone, touchpad, electronic pen, or any other type of input device. Further, the computing system 1200 may include one or more output device(s) 1210, such as a screen (e.g., a liquid crystal display (LCD), a plasma display, or touchscreen), a printer, external storage, or any other output device. One or more of the output device(s) may be the same or different from the input device(s). The computing system 1200 may be connected to a network system 1230 (e.g., a local area network (LAN), a wide area network (WAN) such as the Internet, mobile network, or any other type of network) via a network interface connection (not shown).

In one or more embodiments, for example, the input device 1220 may be coupled to a receiver and a transmitter used for exchanging communication with one or more peripherals connected to the network system 1230. The receiver may receive information relating to one or more temperature/pressure parameters. The transmitter may relay information received by the receiver to other elements in the computing system 1200. Further, the computer processor(s) 1204 may be configured for performing or aiding in implementing the processes described in reference to FIGS. 6A-6F.

Further, one or more elements of the aforementioned computing system 1200 may be located at a remote location and be connected to the other elements over the network system 1230. The network system 1230 may be a cloud-based interface performing processing at a remote location from the well site and connected to the other elements over a network. In this case, the computing system 1200 may be connected through a remote connection established using a 5G connection, such as protocols established in Release 15 and subsequent releases of the 3GPP/New Radio (NR) standards.

The computing system in FIG. 11 may implement and/or be connected to a data repository. For example, one type of data repository is a database. A database is a collection of information configured for ease of data retrieval, modification, re-organization, and deletion. In some embodiments, the database includes published/measured data relating to the method, the assemblies, and the devices as described in reference to FIGS. 1A-5.

While the disclosure has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed is:

1. A drill bit device, the drill bit device comprising:

a cutter housing delimited by an outermost surface and a plurality of walls forming a socket;

a plurality of main cutters disposed on an outermost surface of the cutter housing, the plurality of main cutters being configured to move in an outward direction upon receiving a predetermined pressure;

a plurality of pre-charged cutters disposed immediately behind the plurality of main cutters inside the cutter housing, the plurality of pre-charged cutters being configured to move in the outward direction upon receiving the predetermined pressure; and a gate that connects the cutter housing to an internal groove, the internal groove being directly connected to a port switch that allows release of the predetermined pressure through the internal groove and into the gate, wherein the plurality of walls of the cutter housing are disposed around the plurality of main cutters and the plurality of pre-charged cutters, and wherein the predetermined pressure causes a set of main cutters out of the plurality of main cutters to be released out of the cutter housing and causes a set of pre-charged cutters out of the plurality of pre-charged cutters to move onto the outermost surface of the cutter housing.

2. The device of claim 1, the device further comprising:

a plurality of shear pins corresponding to the plurality of main cutters and the plurality of pre-charged cutters, each shear pin being a short piece of brass or steel that is used to retain the plurality of main cutters and the plurality of pre-charged cutters in a fixed position.

3. The device of claim 2, the device further comprising:

a no-go profile that incorporates a reduced diameter internal profile that provides a positive indication of seating by preventing each main cutter out of the plurality of main cutters to be set from passing through the plurality of walls.

4. The device of claim 3, wherein the no-go profile is a safety that prevents the plurality of main cutters from dropping prematurely.

5. The device of claim 1, wherein the gate is configured to:

compare the predetermined pressure to a threshold, determine that the predetermined pressure is a first type of pressure or a second type of pressure, the predetermined pressure being the first type of pressure when the predetermined pressure is smaller than the threshold and the predetermined pressure being the second type of pressure when the predetermined pressure is equal or larger than the threshold, and only allow the predetermined pressure into the cutter housing when the predetermined pressure is the second type of pressure.

6. The device of claim 1, wherein the plurality of main cutters are attached to the plurality of walls using attachments of different ratings to allow a selective drop of one or more cutters out of the plurality of main cutters, and wherein the plurality of pre-charged cutters are attached to the plurality of walls using attachments of different ratings to allow a selective drop of one or more cutters out of the plurality of pre-charged cutters.

7. The device of claim 1, the device further comprising:

a transceiver that establishes a communication link with a computer system; and a collection controller that transmits a wear status of the plurality of main cutters to the computer system.

8. The device of claim 1, the device further comprising:

a plurality of sensors that samples physical phenomena outside the cutter housing and inside an internal chamber of the cutter housing, the plurality of sensors comprising temperature sensors, pressure sensors, proximity sensors, stabilization sensors, electrical sensors, or photoelectric sensors.

9. A drill bit assembly, the drill bit assembly comprising:

a chassis comprising a connecting thread, a drill bit neck, and a drill bit body;

a plurality of drill bit devices disposed in multiple positions of the drill bit body, each drill bit device comprising:

a cutter housing delimited by an outermost surface and a plurality of walls forming a socket, a plurality of main cutters disposed on an outermost surface of the cutter housing, the plurality of main cutters being configured to move in an outward direction upon receiving a predetermined pressure, a plurality of pre-charged cutters disposed immediately behind the plurality of main cutters inside the cutter housing, the plurality of pre-charged cutters being configured to move in the outward direction upon receiving the predetermined pressure, and a gate that connects the cutter housing to an internal groove, the internal groove being directly connected to a port switch that allows release of the predetermined pressure through the internal groove and into the gate, wherein the plurality of walls of the cutter housing are disposed around the plurality of main cutters and the plurality of pre-charged cutters, and wherein the predetermined pressure causes a set of main cutters out of the plurality of main cutters to be released out of the cutter housing and causes a set of pre-charged cutters out of the plurality of pre-charged cutters to move onto the outermost surface of the cutter housing, wherein the drill bit neck comprises the port switch, and wherein the drill bit body houses the internal groove, the internal groove extending from the drill bit neck to each gate of each drill bit device out of the plurality of drill bit devices.

10. The assembly of claim 9, wherein each socket comprises:

a plurality of shear pins corresponding to the plurality of main cutters and the plurality of pre-charged cutters, each shear pin being a short piece of brass or steel that is used to retain the plurality of main cutters and the plurality of pre-charged cutters in a fixed position.

11. The assembly of claim 10, wherein each socket further comprises:

a no-go profile that incorporates a reduced diameter internal profile that provides a positive indication of seating by preventing each main cutter out of the plurality of main cutters to be set from passing through the plurality of walls.

12. The assembly of claim 11, wherein the no-go profile is a safety that prevents the plurality of main cutters from dropping prematurely.

13. The assembly of claim 9, wherein the gate is configured to:

compare the predetermined pressure to a threshold, determine that the predetermined pressure is a first type of pressure or a second type of pressure, the predetermined pressure being the first type of pressure when the predetermined pressure is smaller than the threshold and the predetermined pressure being the second type of pressure when the predetermined pressure is equal or larger than the threshold, and only allow the predetermined pressure into the cutter housing when the predetermined pressure is the second type of pressure.

14. The assembly of claim 9, wherein the plurality of main cutters are attached to the plurality of walls using attachments of different ratings to allow a selective drop of one or more cutters out of the plurality of main cutters, and wherein the plurality of pre-charged cutters are attached to the plurality of walls using attachments of different ratings to allow a selective drop of one or more cutters out of the plurality of pre-charged cutters.

15. The assembly of claim 9, the assembly further comprising:

a transceiver that establishes a communication link with a computer system; and a collection controller that transmits a wear status of the plurality of main cutters to the computer system.

16. The assembly of claim 9, the assembly further comprising:

a plurality of sensors that samples physical phenomena outside each socket and inside an internal chamber of each cutter housing, the plurality of sensors comprising temperature sensors, pressure sensors, proximity sensors, stabilization sensors, electrical sensors, or photoelectric sensors.

17. A method for releasing cutters from a drill bit assembly, the method comprising:

activating a port switch placed at a drill bit neck of the drill bit assembly;

releasing a predetermined pressure into an internal groove in response to the activation, the internal groove extending from the port switch to a plurality of cutter housings located at an outer surface of the drill bit assembly;

receiving the predetermined pressure in at least one of the plurality of cutter housings, the predetermined pressure being a first type of pressure or a second type of pressure;

comparing the predetermined pressure to a threshold, results of the comparison indicating whether the predetermined pressure is smaller than the threshold or equal or larger than the threshold;

determining the predetermined pressure as the first type of pressure when the predetermined pressure is smaller than the threshold or determining the predetermined pressure as the second type of pressure when the predetermined pressure is equal or larger than the threshold; and releasing a first plurality of main cutters in response to the first type of pressure and releasing a second plurality of main cutters in response to the second type of pressure.

18. The method of claim 17, wherein all main cutters out of the first plurality of main cutters and the second plurality of main cutters are attached to corresponding sockets using attachments of different ratings to allow a selective drop of one or more cutters out of the plurality of main cutters.

* * * * *